US011780547B1

(12) United States Patent
Halliburton

(10) Patent No.: US 11,780,547 B1
(45) **Date of Patent: *Oct. 10, 2023**

(54) SAILING VESSEL

(71) Applicant: Cross Wing Technology Holdings, LLC, Avondale, AZ (US)

(72) Inventor: Duncan Halliburton, Newport, CA (US)

( * ) Notice: Subject to any disclaimer, the term of this patent is extended or adjusted under 35 U.S.C. 154(b) by 686 days.

This patent is subject to a terminal disclaimer.

(21) Appl. No.: 16/370,423

(22) Filed: Mar. 29, 2019

Related U.S. Application Data

(63) Continuation-in-part of application No. 16/262,342, filed on Jan. 30, 2019, now Pat. No. 10,556,641, which is a continuation-in-part of application No. 16/213,766, filed on Dec. 7, 2018, now abandoned.

(51) Int. Cl.

| | |
|---|---|
| ***B63H 9/06*** | (2020.01) |
| ***B63B 1/12*** | (2006.01) |
| ***B63B 1/14*** | (2006.01) |
| ***B63H 9/069*** | (2020.01) |
| ***B63H 9/067*** | (2020.01) |

(52) U.S. Cl.
CPC ..... *B63H 9/069* (2020.02); *B63B 1/121* (2013.01); *B63B 1/14* (2013.01); *B63H 9/067* (2020.02)

(58) Field of Classification Search
CPC ... B63H 9/00; B63H 9/04; B63H 9/06; B63H 9/067; B63H 9/069; B63B 1/00; B63B 1/14; B63B 7/00; B63B 7/08; B63B 7/082; B63B 7/085; B63B 5/00; B63B 5/24; B63B 1/121
USPC ..... 114/39.26, 61.1, 90, 97, 102.1, 112, 354
See application file for complete search history.

(56) References Cited

U.S. PATENT DOCUMENTS

| | | | |
|---|---|---|---|
| 5,517,940 | A | 5/1996 | Beyer |
| 5,860,378 | A | 1/1999 | Schaller |
| 6,089,173 | A | 7/2000 | Lande |
| 7,137,349 | B2 | 11/2006 | Morelock et al. |
| 8,695,520 | B1 | 4/2014 | Berte |
| 10,556,641 | B1 * | 2/2020 | Halliburton ..... B63B 27/36 |

FOREIGN PATENT DOCUMENTS

| | | | |
|---|---|---|---|
| FR | 2778386 | A1 | 5/1998 |
| WO | 2017006315 | A1 | 1/2017 |

* cited by examiner

*Primary Examiner* — Lars A Olson
(74) *Attorney, Agent, or Firm* — LEWIS BRISBOIS BISGAARD & SMITH

(57) ABSTRACT

The present disclosure is directed generally toward sailing vessels. One example is a catamaran with one or more pivoting masts per hull member, which may pivot from a generally perpendicular upright position, to a generally flat stowed position toward the bow of the hulls. The masts are capable of sustaining a plurality of sails, which may travel 180 degrees with respect to the hulls.

20 Claims, 18 Drawing Sheets

SAILING VESSEL

CROSS REFERENCE TO RELATED APPLICATIONS

This application is a continuation in part application of application Ser. No. 16/262,342, filed Jan. 30, 2019, entitled "SAILING VESSEL", which claims priority to, and benefit from, and is a continuation-in-part application, of application Ser. No. 16/213,766, filed Dec. 7, 2018, entitled "SAILING VESSEL", which are all incorporated by reference for all purposes.

FIELD

This disclosure relates generally to catamaran sailing vessels, and more particularly to catamarans with two reclining masts, one mast stepped in each hull, that pivot toward the bow of the vessel.

BACKGROUND

Controlling and directing a sail boat in changing wind conditions may be difficult. With high winds (15-20 knots, gusting 25-30 knots) sailing can be fraught with danger and hazards to the sailor of a tall masted vessel, and can overwhelm the strength and stamina of the strongest of sailors. Sailors have been dealing with these changing wind conditions for many years. Sailing naval architecture has reflected the efforts in dealing with changing wind conditions for many centuries.

Sailboats typically have a tall mast (at least as tall as 1.25 times the length of the vessel and some up to 1.5 times the length), which makes the vessel generally top heavy with sail square footage and have a tendency to tip from side to side opposite from which direction the wind is blowing. The height of the masts and the wind force exerted on the sails attached or rigged to the mast have a rolling or heeling moment of force exerted on the hull of the vessel though the mast that transfers the force to the hull that moves the vessel through the water. The mast also acts as a lever against the lateral or level stability of the vessel, causing it to roll from one side to another opposite the directional force of the wind. The taller the mast, the greater the potential leverage force the mast will exert against the lateral or level stability of the vessel floating on the surface of the water it is traveling over.

This increased or decreased tendency to roll or heel the vessel is called heeling moment. Shortening the mast will lessen the heeling moment of the mast on the vessel, but will also have an adverse effect by reducing the amount of possible sail area to produce speed through the water for the vessel.

The mast is designed to hoist the sails aloft to give the vessel a force or drive to push or pull the vessel through the water. The push or pull force may depend on how the sails are set or rigged on the mast(s). The tall mast may be needed for greater sail area for greater speed of the vessel. This may make it more likely the vessel will capsize, increase the heeling moment, and make it more likely the vessel may front end capsize or "submarine" capsize.

Furthermore, tacking upwind may be difficult and time consuming due to increased wind forces exerted on the taller and larger sail area aloft. These increased wind forces demand more power to handle the sails whether tacking or hauling in the sheet lines for proper sail trim on all points of sail. What is needed is an advanced sailing vessel to allow the operator or skipper to more controllably and safely operate a sailboat in rapidly changing wind conditions.

SUMMARY

The vessel according to the present disclosure is a two hulled catamaran, overcomes the drawbacks of known sailing and land vessel control by providing at least two reclining masts side by side, one mast stepped in each hull laterally opposite the other mast stepped in the other hull. This increases the sail area without requiring a tall mast.

Embodiments disclosed herein include configurations, which allow sail configurations that decrease the tendency for the vessel to heel over or capsize during strong winds, yet maintain adequate sail area aloft. The configuration would also allow the vessel to maintain similar amounts of speed, or greater, than a conventional single-masted Marconi rig mounted on each hull of a catamaran, which would only acquire such speeds on limited points of sail, with the same adequate amount of wind speed (force).

The advantages may include decreased heeling moment that increases the safety factor of the vessel while keeping the same amount of sail area of a Marconi conventional single-masted rig, or increasing the effective sail area substantially compared to a Marconi conventionally rigged twin masted bi-plane sail configuration (see FIG. 8B).

Shortening the mast will lessen the heeling moment of the mast on the vessel, but will also have an adverse effect by reducing the amount of sail to produce speed through the water for the vessel. By splitting the reduced height mast rig laterally (where the mast height is 1.0-1.25 mast height to 1.00 length of vessel) or width wise utilizing the extra beam (vessel width measurement) of a catamaran, a designer can step (or position) a mast to the side of another mast with enough space or distance width wise (laterally) between the masts to establish or design a sail rig with enough lateral space between the two sail configurations to create a "slot" or space by which "clean air" or non-turbulent wind from the windward sail configuration can pass to leeward, or downstream of the windward sail configuration, to allow non-turbulent wind or "clean air" to pass and effectively engage, and be harnessed by the leeward sail configuration.

Previous designs of a bi-plane rig including a split fore and aft Genoa and mainsail on one mast (a Marconi rig) stepped in one hull of a two hull catamaran, and another mast with a split fore and aft Marconi genoa and mainsail sail combination rigged on the second mast stepped in the other catamaran hull of this two hulled vessel. This configuration creates a turbulent or "dirty air" blanketing effect on the leeward mainsail of the leeward Marconi sail rig configuration on close reach and beam reach points of sail, on the twin masted bi-plane rig. The windward Genoa spills turbulent air (or in sailing terminology—"dirty air") into the leeward mainsail, interrupting the clean flow of air around the parabolic foil of the mainsail. This decreases the performance characteristics of the leeward mainsail, decreasing the sail power, or pull, of the leeward sail rig to help propel the vessel through the water.

Embodiments, examples, features, aspects, and advantages of the present disclosure will become better understood with regard to the following description, appended claims and accompanying drawings.

BRIEF DESCRIPTION OF THE DRAWINGS

The foregoing aspects and the attendant aspects of the present disclosure will become more readily appreciated by reference to the following detailed description, when taken in conjunction with the accompanying drawings, wherein.

Figure 1:
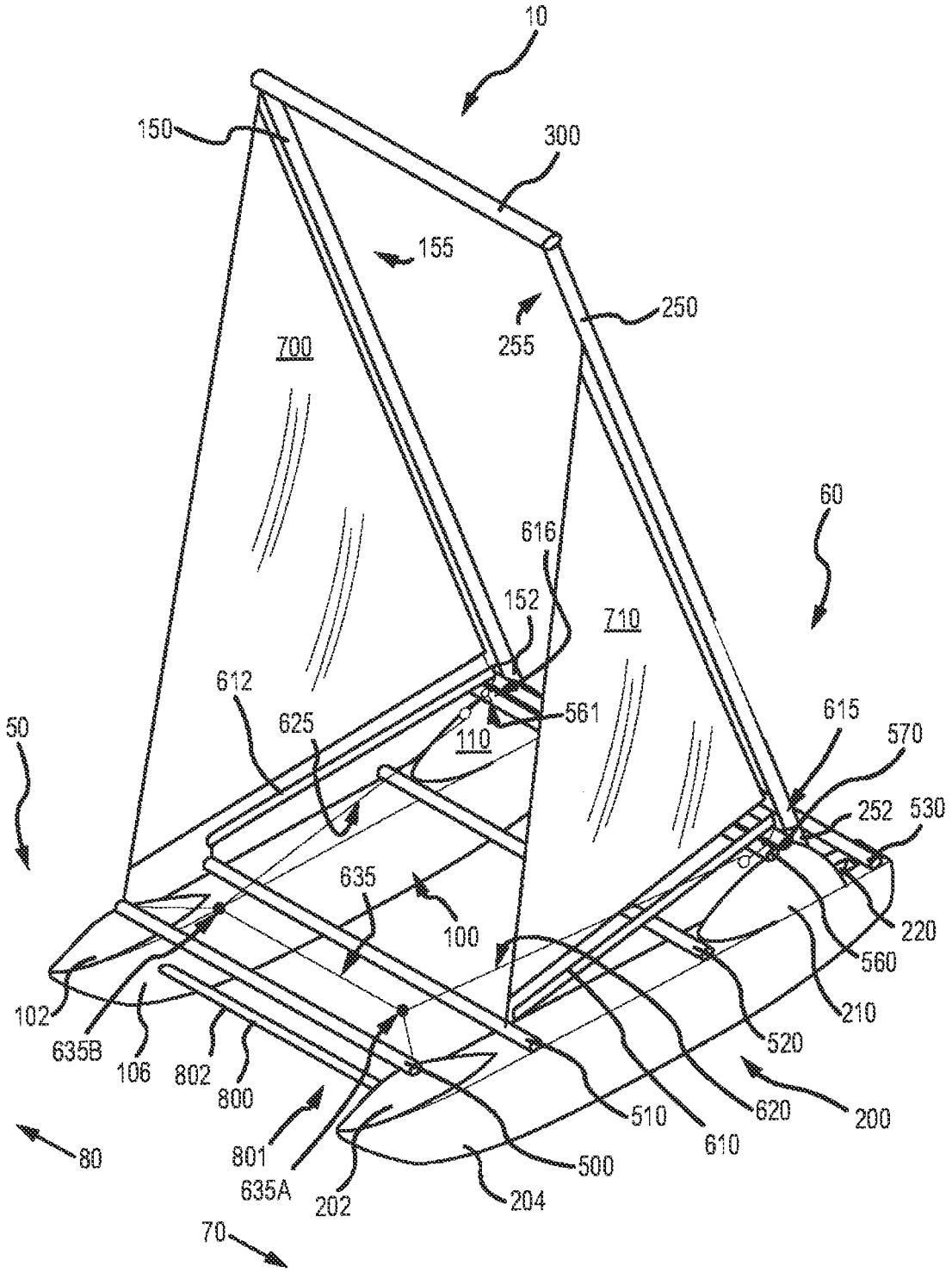
FIG. 1 is a plan view of a vessel according to an embodiment.

Reference symbols or names are used in the Figures to indicate certain components, aspects or features shown therein. Reference symbols common to more than one Figure indicate like components, aspects or features shown therein.

DETAILED DESCRIPTION

In accordance with embodiments described herein may include a catamaran type sailing vessel, where the vessel includes two masts, which pivot with respect to two hulls. This may allow for more sail surface area with generally shorter masts, which makes the vessel less prone to be leveraged to capsize sideways or front end submarine capsize ("endo").

The masts may also pivot with respect to the hull from a generally up position of about 70-90 degrees with respect to the hulls, to a generally down position where the masts are about minus 20 to plus 10 degrees with respect to the hulls (See FIGS. 1, 2, 3A, 3B and 8I).

The vessel may also include a stabilizer or "hydrovane" stabilizer foil that is foiled similar to a hydrofoil vane in cross section but is dissimilar as to the longitudinal geometry of the hydrovane and how it is attached to the catamaran hulls compared to conventional mounting of hydrofoil structures to single hulled vessels. The "hydrovane" stabilizer foil (hereinafter "hydrovane") is structurally attached to each inboard surface of the bow sections of both hulls of the catamaran spanning the width or beam of the catamaran on the inboard side from one hull to the other (See FIGS. 1, 2, 3A and 6).

In regards to longitudinal placement (fore and aft) on the bows, the hydrovane may be mounted aft of the leading edge of the bow by a distance of ½ the height of freeboard (distance between the waterline and the deck of the vessel) in the bow section. The vertical placement of the hydrovane on the bow section between the hulls of the catamaran would be ⅔ up from the waterline of the hull to the decks of the vessel.

This would allow the engagement of the hydrovane with the surface of the water to occur at a point where the user would acquire a concern that plunging bows of the catamaran are close to the point of burying themselves in the ocean or water surface. That would entail burying the bows underwater at a boat planing or surfing speed that begins to exceed the safe boating speed in a choppy condition that includes wave heights exceeding the height of the vessel's freeboard.

In a following sea where the wave heights exceed the height of the freeboard and the wind is commensurate with the wave heights, possibly exceeding 20 knots, periodically the bows would angle down and start to plunge or submerge under the water on a broad reach and downwind run points of sail. But the hydrovane would enter the ocean and become submerged. That is when the configuration of the hydrovane begins to lift up the bows from a dangerous plunging or submarine capsize position, to one where the bow decks would ride free and clear above the ocean.

The hydrovane may be coupled generally adjacent the front portion of the bows of the hulls. The hydrovane may have a general foiled wing cross section, including a flat lower surface 801 and generally parabolically curved convex upper surface 802, similar to an aircraft wing to create lift if submerged. The configuration would decrease the likelihood that the bows of the vessel may front end submarine capsize when the hydrovane is submerged and going at a high rate of speed beyond planning or a surfing boat speed (approximately 15+ knots) (See FIG. 2).

The hulls may also include a generally bulbous streamlined buoyant portion 102, 202 adjacent the bow of each hull. This would add buoyancy, volume, and hydrodynamic streamlining to the bows of the vessel, to reduce the likelihood that the deck of the bow of the vessel will be exposed to the force of a large volume of surface water coming over the top of the deck of the bow, and act like a diving plane on a submarine, forcing the bows underwater (See FIGS. 1, 2, 3A and 4).

FIG. 1 illustrates an example vessel 10, which includes a first or starboard hull member 100 and a second or port hull member 200. Vessel 10 includes a bow portion 50, and a stern portion 60, as well as a port side 70 and a starboard side 80.

Vessel 10 also includes a first or starboard mast 150, a second or port mast 250, a hydrovane stabilizer 800, and one or more spars 500-570.

In the embodiment shown in FIG. 1, masts 150, 250 may be pivotally coupled to respective hulls 100, 200 to allow the masts 150, 250 to generally pivot toward the bow 50 of the vessel 10. Masts 150, 250 may be generally coupled adjacent a top portion 155, 255 of the masts 150, 250 by a capspar 300. This configuration along with high strength fiber or wire stays, prevents any sideways or side falling movement by one mast without the other mast. The two masts 150, 250 connected by the capspar 300 (shown in FIG. 5) on top are held up and "stayed" by a generally "criss-cross" wire configuration or high strength fiber rope matrix (Spectra rope) resembling crossing of stays 180, 280 that prevents the sideways motion of the mast 150, 250 from falling down as to bear the load of sail aloft to drive the boat through the water at a high rate of speed.

Masts 150, 250 may generally be about 1.0-1.25 times the length of the vessel 10, instead of current systems with masts of about 1.25-1.50 times the length of the vessel. This allows a greater reduction in heeling moment with the bi-plane rig as compared to a single-masted Marconi rig, with the heeling tall mast leverage of a 1.3-1.5 boat length to mast height proportion.

Figure 8A:
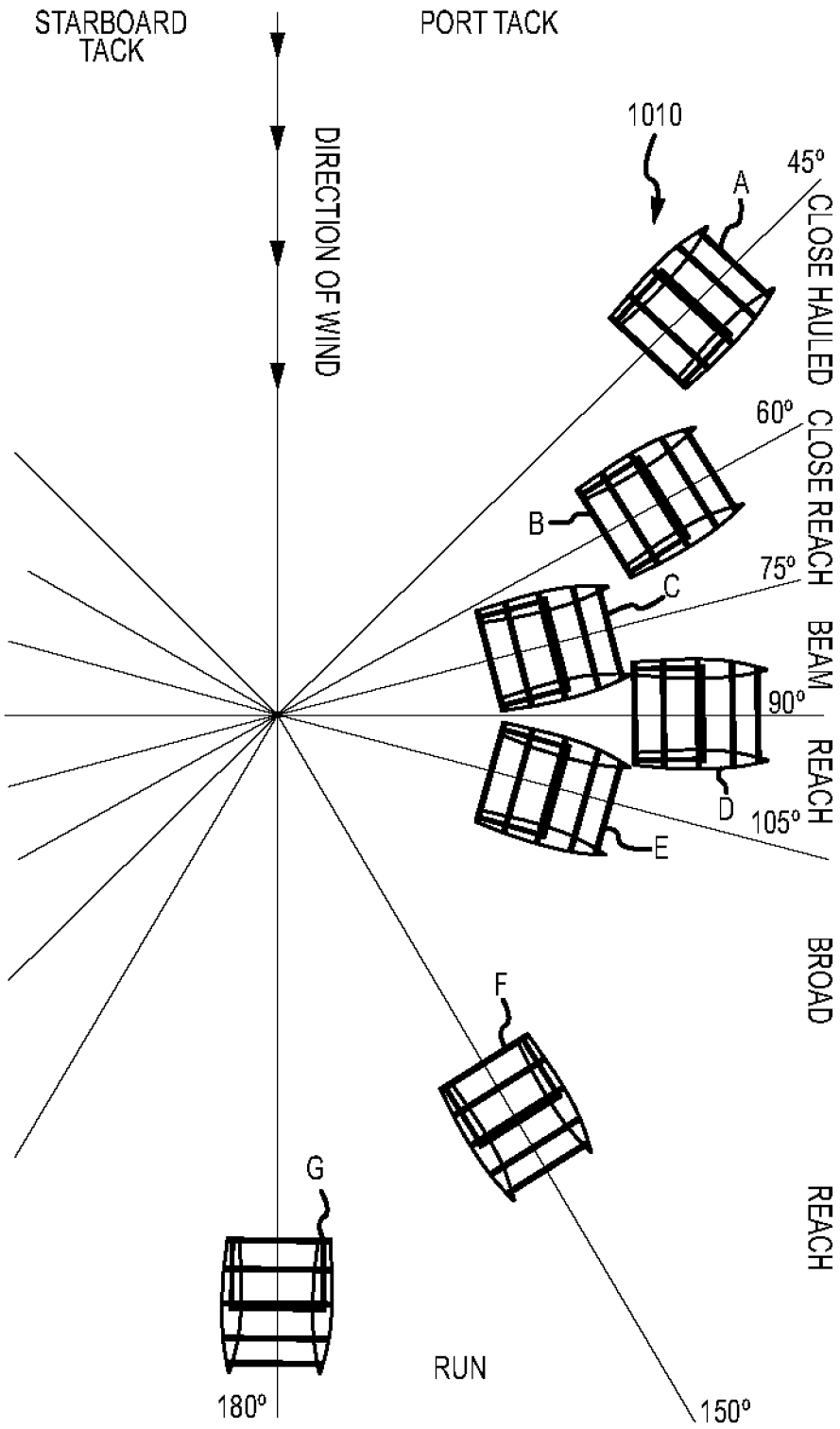
FIG. 8A shows a vessel at different positions in relation to the wind direction, called points of sail, according to an embodiment.

Vessel 10 may also include a 150% Genoa sail 700 and a 90% Genoa staysail 710 may be coupled adjacent the masts 150, 250 extending generally toward the bow 50 of the vessel 10 with the standing rigging and bi-plane mast support structure of stays or high strength fiber and spar structural support, generally extending toward the stern 60 of the vessel 10. This configuration allows the 90% Genoa staysail 710 in tandem with a 150% Genoa 700 movement of 180 degree or possibly more degrees arc of travel of the sails unencumbered 700, 710 when in use thereby allowing for more control of the vessel 10, through the arc of points of sail positioning for the different wind directions, as shown in FIG. 8A, but allow optimal performance on close reach to beam reach points of sail as in FIG. 8D where the reduced windward rig of the staysail 710 (FIG. 1) is reduced from a 150% (700 in FIG. 1) Genoa to the 90% staysail (710 in FIGS. 1, 2, 4, and 8D) so as not to "blanket" or "shadow" the larger leward 150% Genoa on the biplane rig. These foresail (Genoa and/or staysail combinations) are the main sail drives for the vessel 10. An after or stern rigged sail or mizzen 740 or mini mizzen 750 (FIGS. 2, 4 and 6) can be utilized aft of the mast to provide more weather helm that may be desired, depending on the point of sail or how the naval architect distributes the sail center of effort and the underwater profile area relating to the center of leeward resistance on the leeward hull.

The trialing edge of the mizzen (clue) 759A, 759B is attached to a mizzen sheet line 760 that proceeds through a block 925, that is attached to a traveler car 920, that slides along a traveler rail 910 that is attached to the mizzen pivot boom 900, which pivots off the top of the back stay strut 251 and on the port tack (position 900A) with full mizzen shown 740 (FIGS. 2, 4, and 6) with the trailing edge of 740 attached to a mizzen sheet line 760 that proceeds through a block 925 and attaches to a 4 to 1 purchase 930 that is attached to point 904 on mizzen pivot boom 900 at position 900A. The block 925 that is attached to traveler car 920 (adjusted by control line 921), slides on a traveler rail 910 attached to mizzen pivot boom 900, which is attached to the base of the back stay strut 251 at a point 904 at the end of mizzen pivot boom 900A (position A) in FIG. 6.

The head or top of the mizzen 740 or mini mizzen 750 is attached to a traveler car 950 that slides on traveler rail 940 (FIGS. 2, 5, and 6) mounted underneath the capspar 300 extending underneath the capspar from the starboard mast 150 to the port mast 250. A traveler car control line 951 can pull the traveler car 950 to the port mast 250 for the disposition of the mizzen sail 740, 750 on the port tack, or another traveler car control line 952 for pulling the traveler car 950 to the starboard mast 150 for disposition of the mizzen sail 740, 750 on the starboard tack is made possible by tightening or loosening the mizzen sail 740, 750 downhaul 970 at the lower leading edge of the mizzen sail 740, 750 (called the tack).

Figure 2:
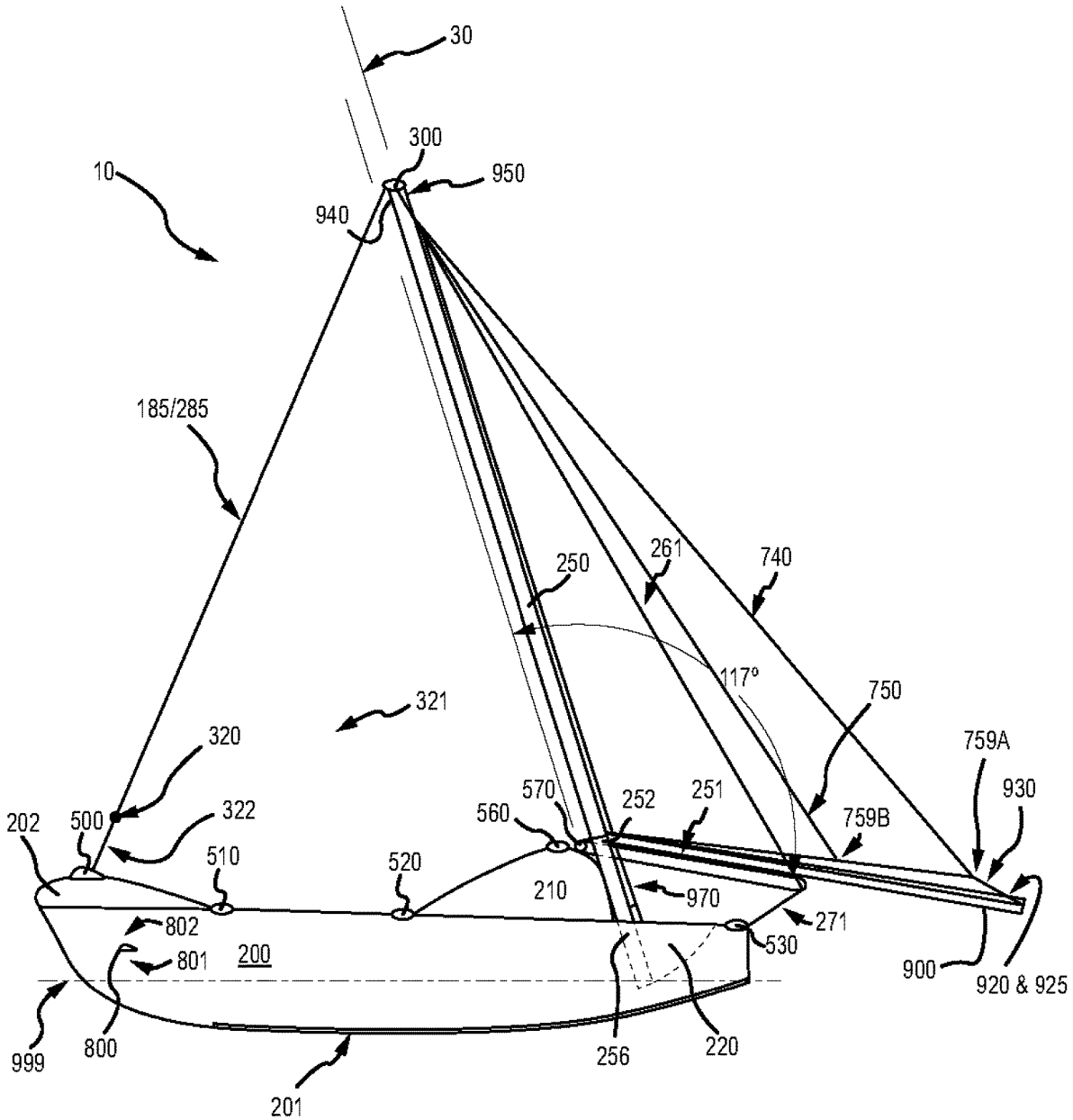
FIG. 2 is a side view of a vessel, showing the mast in a generally upright position, according to an embodiment.
Figure 4:
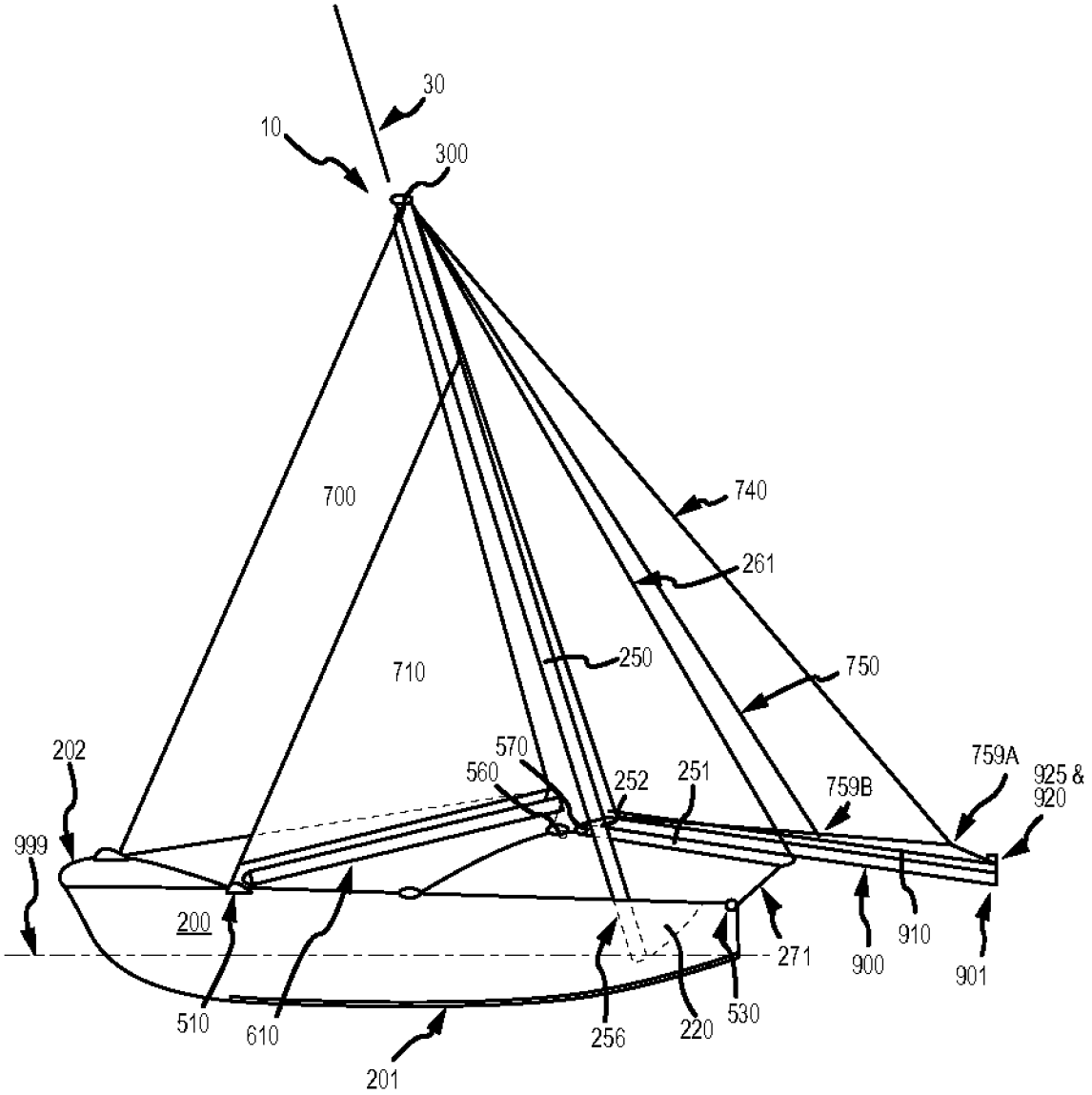
FIG. 4 is a side view of a vessel, showing the mast in a generally upright position with sails unfurled, according to an embodiment.
Figure 5:
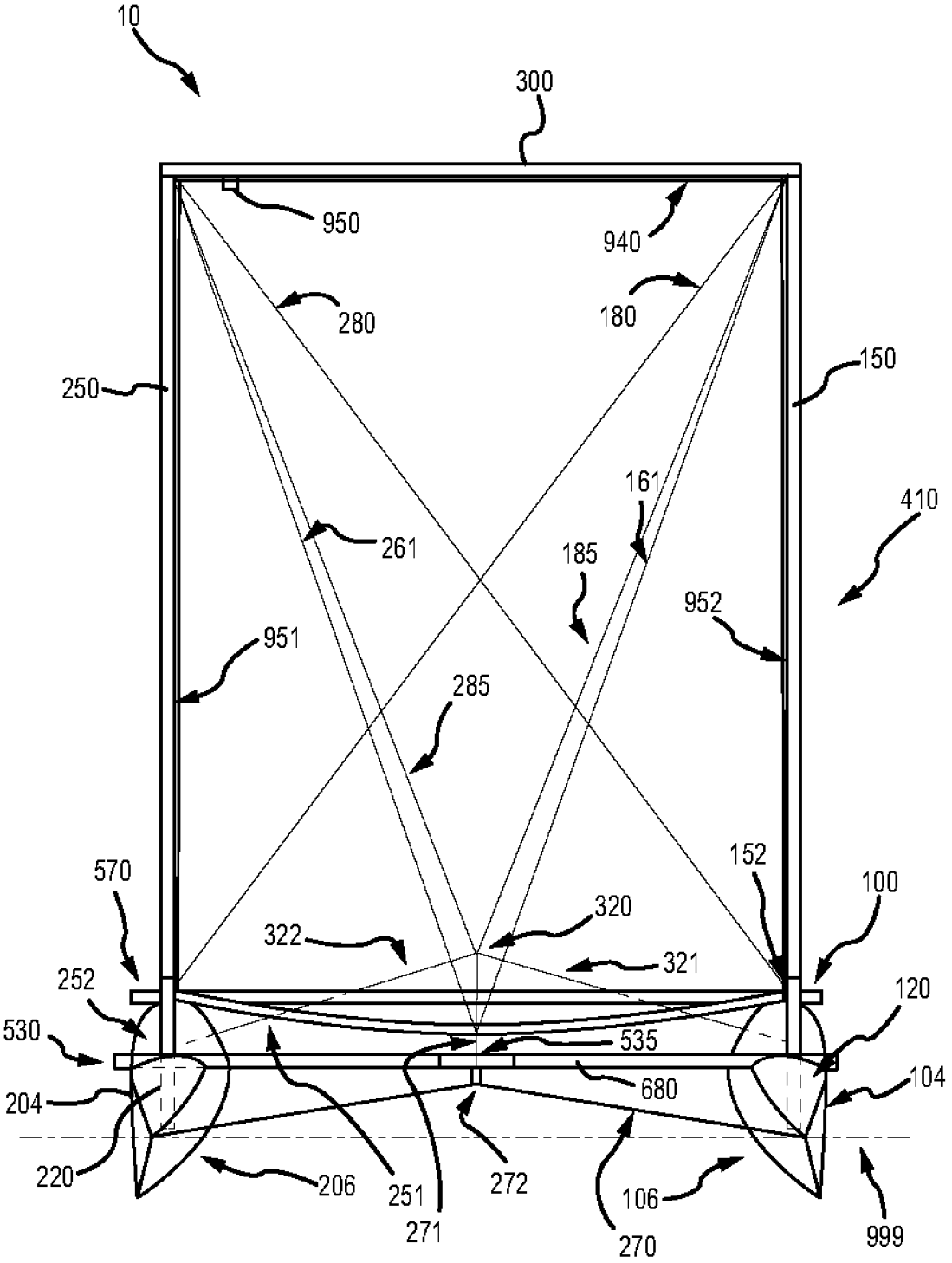
FIG. 5 a rear view of a vessel according to an embodiment.
Figure 6:
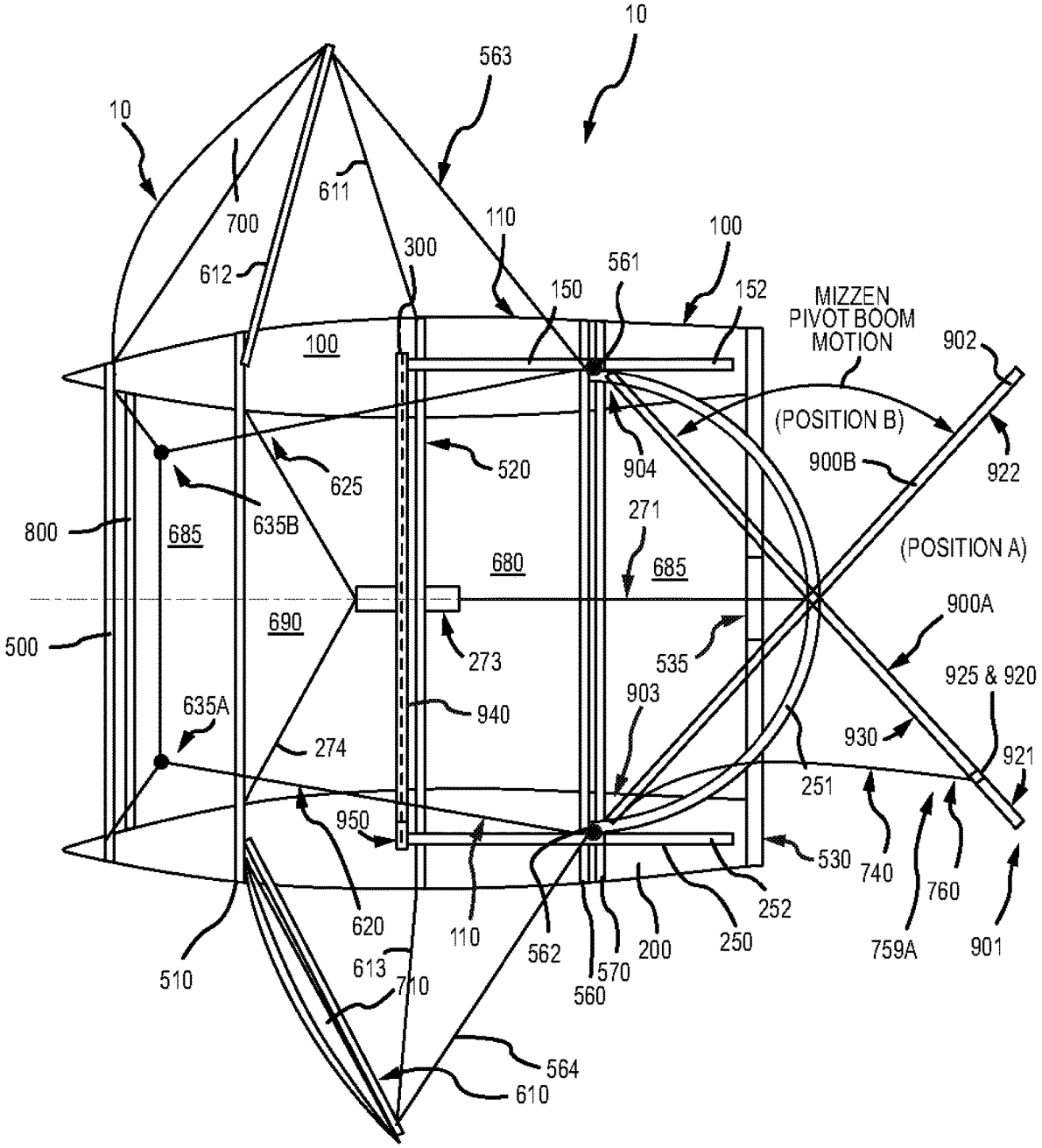
FIG. 6 is a top view of a vessel, according to an embodiment.

The mizzen downhaul 970 is a 4 to 1 purchase attached to the base of the mast step tube 252 at the level of the deck of vessel 10 on the port tack (See FIG. 2). When going from the port tack to the starboard tack, the 4 to 1 purchase 930 is loosened at point 904 (FIG. 6) and the mizzen sheet line 760 is loosened and detached from the mizzen sail 740, 750, and the mizzen downhaul 970 is loosened at 903 (FIG. 6), then detached from the mast step tube 252 at the level of the deck (FIG. 2). The downhaul 970 is them flung or pulled by rope under backstay 181, 261 (FIGS. 2, 4, and 5) and attached to mast step tube 152 at the level of the deck of vessel 10 (FIG. 6). The mizzen sail is pulled under backstays 181, 261 to the starboard side (FIGS. 2, 4, and 5). The capspar traveler car 950 is freed up by loosening control line 951 and the car 950 is pulled over from the port mast 250 to the starboard mast 150 by control line 952 (FIG. 5). The 4 to 1 purchase 930 is detached from point 904 (FIG. 6) and swung around to the stern side and outside of back stays 181, 281 (FIGS. 2, 4, and 5).

The mizzen pivot boom 900A (position A) is detached from the top of back stay strut at point 904 and pivoted so the end of boom 900A at the stern end of 901 is attached to the top of back stay strut 251 at the point 903 with a spinnaker pole attachment (FIG. 6). The mizzen sheet line 760 that proceeds through block 925 attached to traveler car 920, whose control line 921 is freed up to traveler car 920 at point 901 with the mizzen sheet line 760 loosened previously by loosening 4 to 1 purchase 930, such mizzen sheet line 760 is detached from the trailing edge (clue 759A, 759B) (FIGS. 2, 4, and 6) of mizzen 740, 750 and proceeds through block 925 attached to a traveler car 920 that slides on a traveler rail 910 (FIG. 4) to point 902 (FIG. 6) and traveler car be secured by the control line 922 at the end of mizzen pivot boom 900B (now in the starboard tack) at point 902 (FIG. 6). Control line 922 that secures travel car 920 near point 902, trails back to point 903 on mizzen pivot boom 900B (position B) that is now on the starboard tack. Control lines 921 and 922 may be continuous and connected to opposite sides of traveler car 920. The control line proceeds down the mizzen pivot boom 900B to appoint 903 where it is secured (FIG. 6). The down haul 970 is tightened at the mast step tube 152 at the deck level and the mizzen sheet line is attached to the trailing edge of mizzen sail 740, 750 and the 4 to 1 purchase 930 is attached to point 903, is then tightened to trim the mizzen sail 740, 750.

Utilization of mizzen sail 740, 750 in conjunction with mizzen pivot boom 900, is best implemented on long passages on the same tack. The 50% increase in sail area for a low center of effort and maintaining a low heeling moment is commensurate with the safety performance factor of vessel 10.

Hulls 100, 200 may also have generally bulbous, streamlined bow portions 102, 202, generally near the bow 50 of the vessel 10. The volume of the streamlined bow chambers or bulbous portions may increase buoyancy of the vessel 10. This configuration makes it less likely that the bow 50 of vessel 10 will inadvertently submarine capsize or pitch pole when operating in heavy weather (20+ knots of wind) in downwind points of sail with following seas of wave heights exceeding the freeboard (distance vertical between the water line and the deck) dimension of the vessel (See FIGS. 1, 2, 3A, and 4).

Vessel 10 may also include a hydrovane or stabilizer 800. Stabilizer 800 may be generally flat on the bottom, and have a generally parabolic, wing-like, convex top cross section. This configuration may make it less likely the bow 50 of the vessel 10 will submarine capsize or pitch pole with a downwind following sea with high rates of boat speed (15+ knots) surfing down ocean swells (See FIGS. 1, 2, and 6). Utilization of mizzen sail 740, 750 is conjunction with mizzen pivot boom 900, is best implemented on long passages on the same tack. The 50% increase in sail area for a low center of effort and maintaining a low heeling moment is commensurate with the safety performance factor of vessel 10.

The hydrovane 800 may be coupled generally adjacent the front portion of bow 50 of the hulls 100, 200. The hydrovane 800 may have a general foiled wing cross section, including a flat lower surface 801, and generally parabolically curved convex upper surface 802, similar to an aircraft wing to create lift when submerged and proceeding forward at a high rate of speed (15+ knots). This feature would decrease the likelihood that the bow 50 of the vessel 10 may front end submarine capsize or pitch pole when the hydrovane 800 is submerged and going at a high rate of speed beyond planning or a surfing boat speed (approximately 15+ knots) behind large following ocean swells (See FIGS. 1, 2, and 3A).

In FIGS. 1 and 6, hulls 100, 200 may also include a dome or nacelle portion or structure 110, 210 for protection of the sailor from the weather. Spars 500-570 may include a traveler spar 560 that provides a foundation for two fixed linear traveler cars (561 for the starboard rig, and 562 for the port rig in FIG. 6) through which the staysail or Genoa sheet lines 563 for starboard and 564 for port, pass through the travel cars 561, 562 that control the angle of the pull of the sheet lines controlling the positions of the booms on which the clue of the headsails 700 and/or 710 are attached, and a dome spar 570, which hinges the back stay strut 251 (omitted in FIG. 1 for clarity) off the domes 110, 210, and structurally connects the domes 110, 210 of the hulls 100, 200 of vessel 10 (See FIGS. 1, 2, 3A, 4, 5, and 6).

In FIG. 6, traveler cars 561, 562 are coupled adjacent traveler spar 560, and their positions can be linearly adjusted along the length of spar 560 with traveler car control lines (not shown).

Figure 3A:
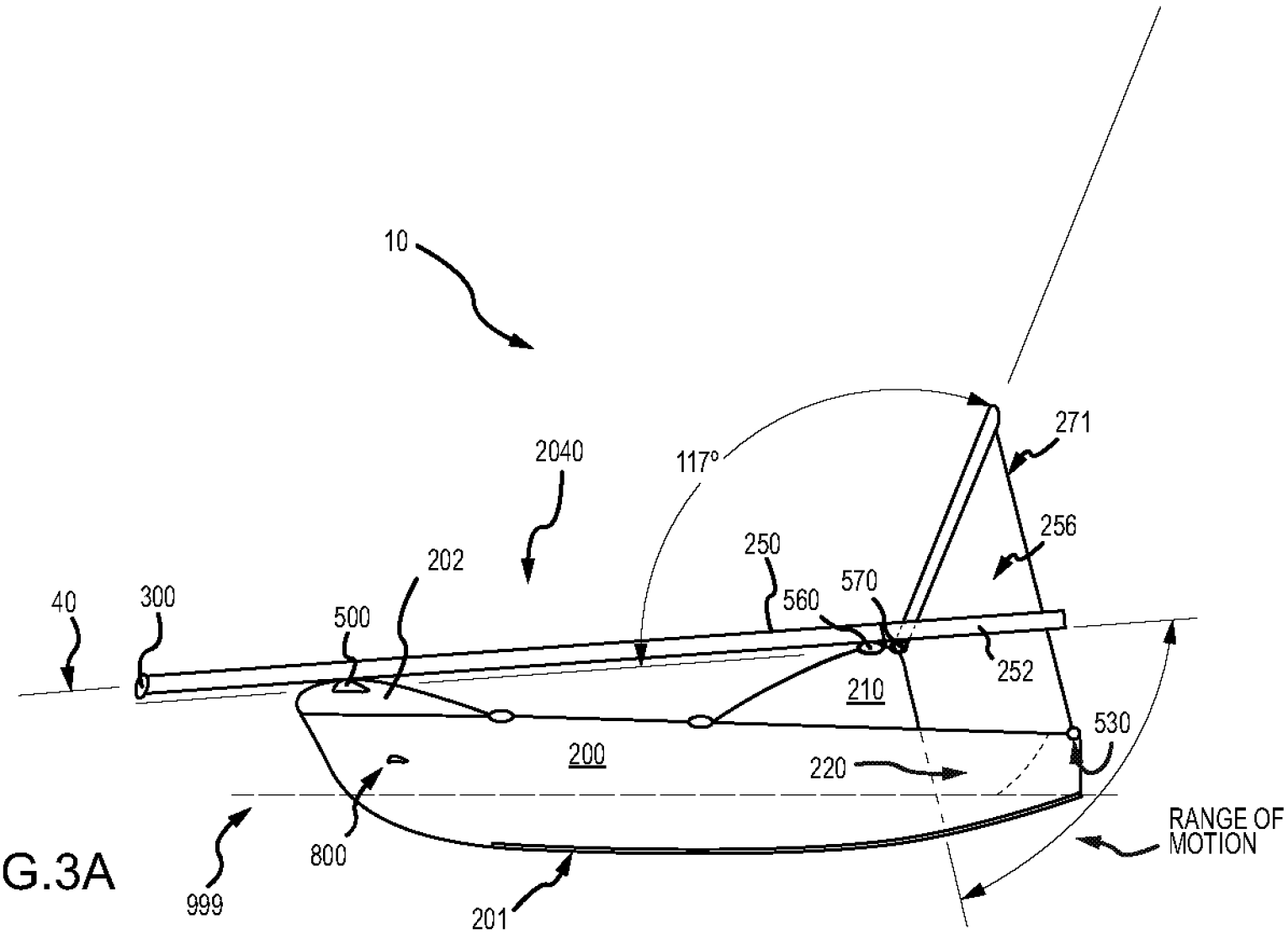
FIG. 3A is a side view of a vessel, showing the mast in a generally lowered position, according to an embodiment.
Figure 3B:
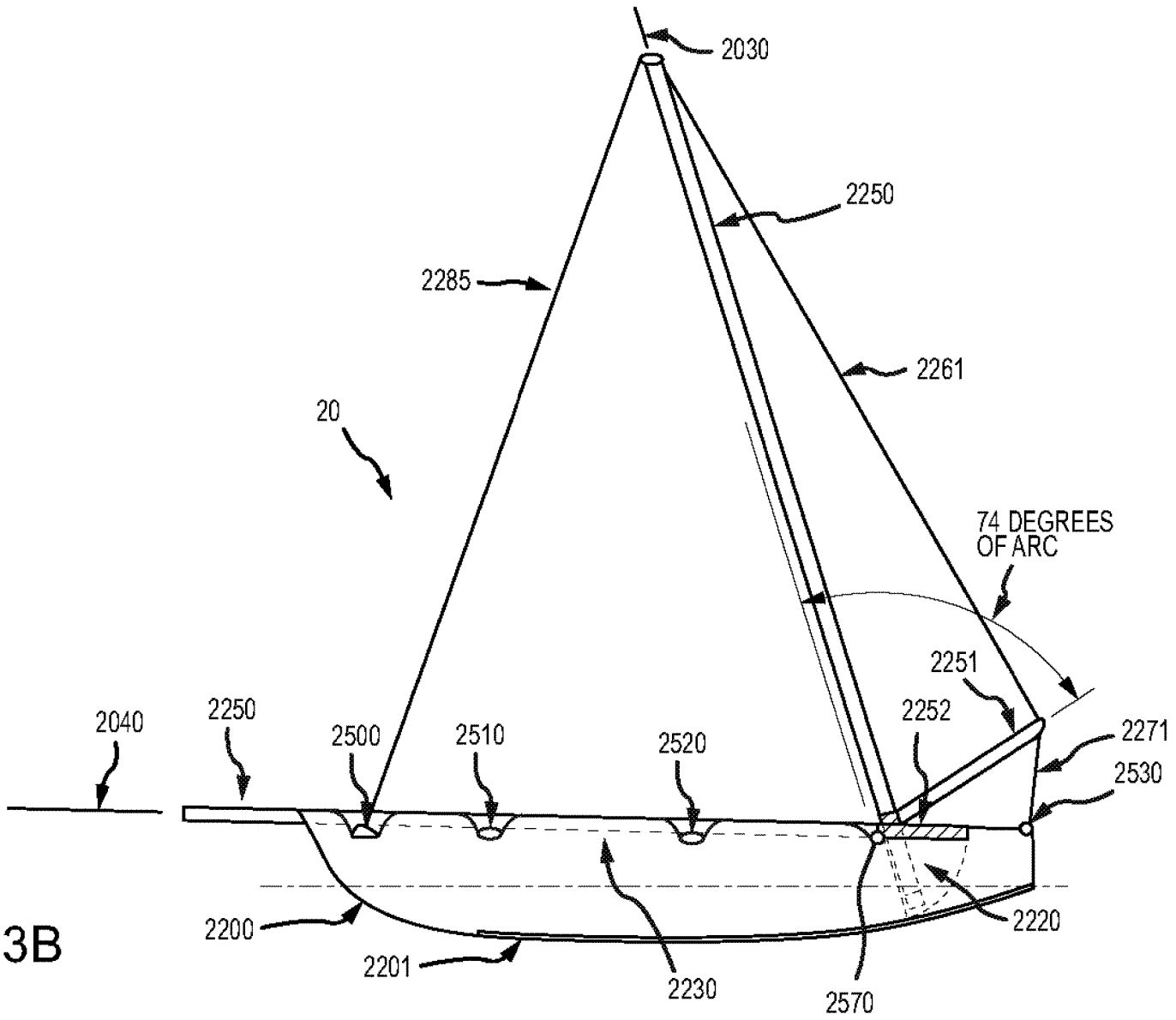
FIG. 3B is a side view of a larger version vessel with a generally flush deck, showing the mast in a generally lowered position, according to an embodiment.

Vessel 10 in FIGS. 2, 4 and 5, and vessel 20 in FIG. 3B may also include back stays 161, 261 (FIGS. 2, 4, and 5), 2161, 2261 (FIG. 3B) attached to the top of the masts that lead down to, and are attached to, the back stay strut 251 (in FIGS. 2 and 5), 2251 (in FIG. 3B). The fore stays 185, 285 (in FIGS. 2, 4 and 5) for vessel 10, and 2185, 2285 (in FIG. 3B) for vessel 20, are attached to the top of the mast and lead down the center point of the forestay bridle 320, which is attached to spar 500 by the starboard forestay bridle 321 and the port forestay bridle 322 (See FIGS. 2, and 5). Spar 500 on top of the bulbous streamlined bow portions 102, 202, will have a generally foiled wing cross section, including a flat lower surface and a generally parabollically curved convex upper surface. The configuration would decrease the likelihood that the bows of the vessel 10 may front end submarine capsize or pitch pole when spar 500 on vessel 10 or spar 2500 on vessel 20 (FIG. 3B), is submerged and going at a high rate of speed beyond planning or a surfing boat speed (approximately 15+ knots) in weather conditions of 20+ knots of wind with large (8+ foot) following ocean swells.

Back stay strut 251 may be configured to pivot or hinge off the domespar 570 to, allow the sailor to raise and lower masts using a control line 271 (See FIGS. 2, 3A, 4, and 5) that passes over stern roller 535 and through a block 272 (FIG. 5) in the center of a back stay stern bridle 270 (FIG. 5). The control line 271 is then attached to a 6 to 1 pulley purchase system 273 (FIG. 6), coupled to a support bridle 274 attached to the outer ends of spar 510 (See FIG. 6). Back stay strut 251 may pivot (See FIGS. 2, 3A, 4, 5 and 6) with respect to the dome spar 570 to control the position of masts 150, 250 generally in unison or in parallel together. On vessel 20 (FIGS. 3B and 8I), back stay strut 2251 may pivot with respect to cross spar 2570 to control position of masts 2150, 2250.

Vessel 10 may also include a boom 610 attached to a Genoa sheet line 564 that passes through a block (not shown) attached to a traveler car 562. Genoa sheet line 564 is then coupled to a block and tackle 620, to adjust the port Genoa sheet line 564. Boom 610 may be configured to couple adjacent to a staysail 710, or switch to a larger 150% genoa sail 700, mast 250, and to pivot, unencumbered by masts 150, 250, from spar 510 (See FIG. 6) to generally hold the sail 700 or 710 in position. In this configuration, block and tackle 620 and Genoa sheet line 564, may generally couple to bow bridle 635A (FIGS. 1 and 6) attached adjacent spar 500 leading block and tackle Genoa sheet lines away from the multi-positioning operation of the boom 610 (FIG. 6). Genoa sheet line 563, passes through a block (not shown) attached to a traveler car 561, which is capable of sliding to different positions relative to traveler spar 560, to generally allow the positioning of the sail 700 with respect to the boom 612 and the mast 150.

Boom 612 has corresponding attachments including a Genoa sheet line 563, which passes through a block (not shown), which is attached to a traveler car 561. Genoa sheet line 563 then attached to block and tackle 625, which couples adjacent bridle 635B (FIGS. 1 and 6), to generally allow the unencumbered positioning of the boom 612 with respect to the wind direction relative to the course of the vessel or defined points of sail (See FIGS. 1, 6, and 8A). In FIG. 6, both block and tackle 620 for the port hull 200, and block and tackle 625 for the starboard hull 100 are drawn for clarity to their full extended payout or position that would allow the positioning of the respective sails to accommodate a downwind point of sail.

Hulls 100, 200 may be generally hollow, and may be made with high tenacity fiber composites reinforced with high strength ribs and/or lapstrake-type outer surface hull construction, with the lapstrake running longitudinally from front to back on the outboard side of the hull 100, 200. Alternatively high strength ribs on the interior of hull 100, 200 may be made of high tenacity fiber tubular construction coupled or adhered to the interior of hull 100, 200. The lapstrake configuration would decrease the likelihood that vessel will front end capsize, the edge of the lapstrake surface in the bow section acting as a lifting planing surface, as well as enhance the longitudinal stiffness of the hulls and strengthen the sides of the hulls against any lateral forces (waves) or blows (foreign objects).

A high strength thermoplastic resin, such as polyethylene terephthalate and/or Zytel ST may be used in the hull construction as well as an outer coat of aircraft grade linear polyurethane or epoxy paint. A stainless steel or high strength plastic, polymer, and/or composite material for the keel skids 101, 201, 2201 embedded with abrasive resistant ceramics or abrasion resistant hardened metal alloy attachments or inserts to the high strength plastic, can shield the abrasive effect on the high strength keel skids 101, 201 running fore and aft on all keels of the catamaran hulls 100, 200, 2200 (shown in FIGS. 2, 3A, 3B and 4), thereby protecting the hull laminate or thermoplastic material in the keel area from landing and launching from a beach area of sand, rock, or coral, and/or combinations thereof. It will be appreciated that other strong lightweight materials may be used in construction and location of the keel skids 101, 201.

Masts 150, 250 and spars 300, 500-570 may be constructed with aircraft aluminum alloy tube, reinforced with high tenacity fibers filament wound onto the parabolic and cylindrical geometry of the aluminum alloy tube (See FIGS. 1, 2, 3A, 4, 5, and 6). It will be appreciated that other strong lightweight materials may be used. Sails 700, 710 may be made from ultra violet resistant sail cloth for longer usage (See FIG. 1).

FIG. 2 shows a port side view of a vessel 10, according to an embodiment. FIG. 5 shows hulls 100, 200, which may be asymmetrical in cross section and may have a generally flat outboard side 104 and a generally convex or outwardly bowed inner side 106. This configuration makes it possible to not include a center board, dagger board, or keel due to the leeward resistance that the leeward hull under sail and under way exerts on vessel 10. This would allow sailing of vessel 10, 20, 1010 in relatively shallow waters. FIG. 5 also shows water line 999 for reference.

The embodiment in FIG. 2 shows the mast 250 in the upright position 30. Upright position 30 (FIGS. 2 and 4) of mast 250 may be about 70-90 degrees relative to the hull 200. Also shown is the bulbous streamlined bow portion or chamber 202, and the relative water line 999 with respect to hull 200 and vessel 10.

Figure 7:
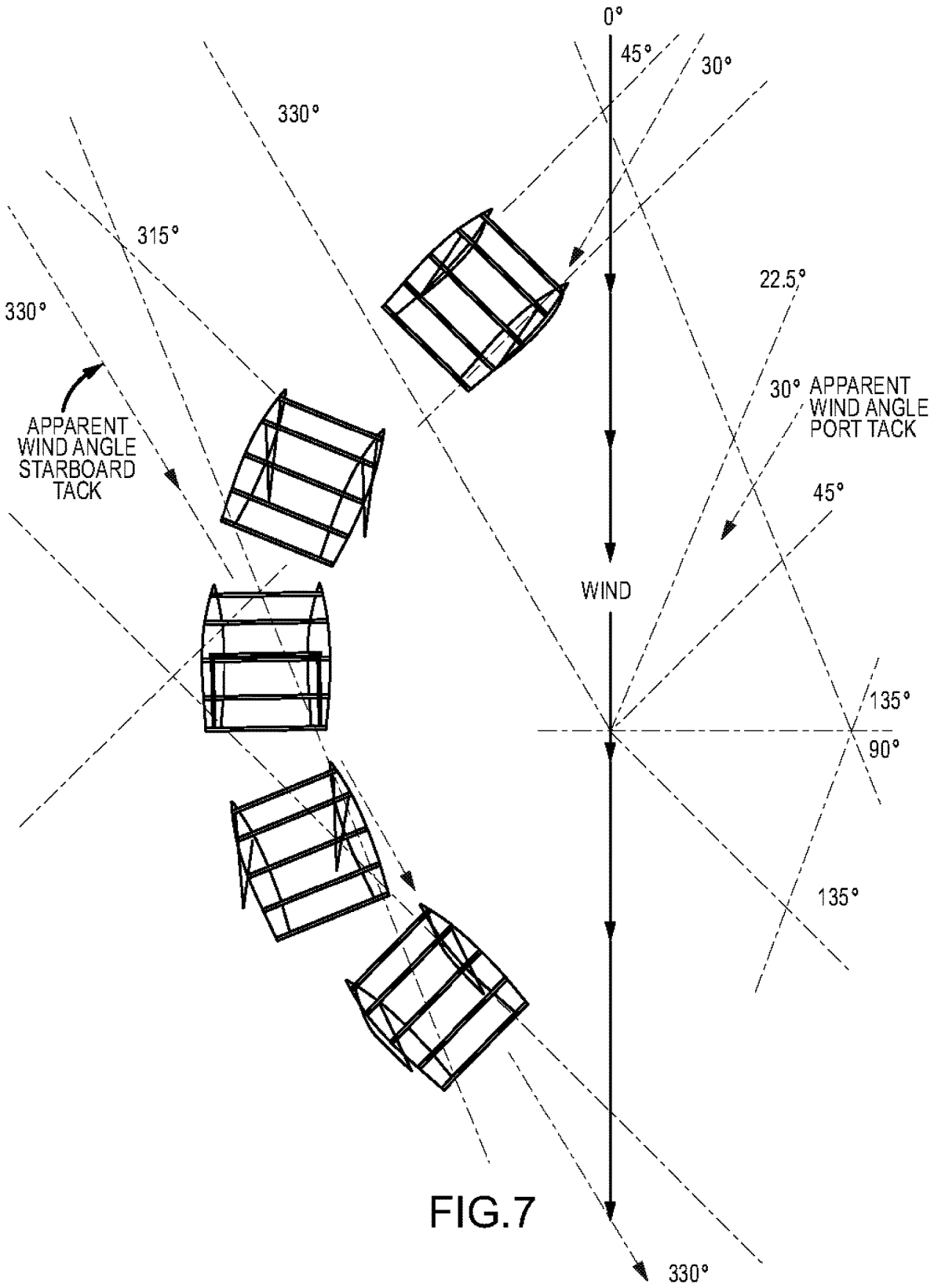
FIG. 7 shows an overhead view of a vessel tacking in close hauled points of sail, according to an embodiment.

Vessel 10 also includes a back stay strut 251 (shown in FIGS. 2, 3A, 4, 5, and 6), which may be pivotally or hingedly coupled adjacent the dome spar 570 and inboard of the mast step tubes 152, 252 (shown in FIGS. 3A, 5 and 6) to allow a sailor to use the back stay strut 251 to raise, lower, or generally change the position of the masts 150, 250 with respect to the hulls 100, 200, and the sail configuration unencumbered by the masts 150, 250 in the raised position 30 (see FIGS. 2 and 4), when the Genoa 700 and Genoa staysail 710 swings from port tack to starboard tack and back again (FIG. 7). With this configuration the sails 700, 710 may have 180 degrees or greater degree arc of unencumbered travel (See FIGS. 1, 2, 3B, 4, and 6). Vessel 20 in FIG. 3B, includes a back stay strut 2251 which may be pivotally or hingedly coupled adjacent cross spar 2570 and inboard of the mast step tubes 2152, 2252, and similar to vessel 10 in operational configuration represented in FIG. 6.

FIG. 3A is a side view of a vessel 10, showing the mast 250 in a generally lowered, stowed, or fully down position 40, according to an embodiment. In this embodiment, stowed position 40 may be when the mast 250 is about minus 20 degrees with respect to the hull 200. With the masts 150, 250 in the down position 40, a kite sail (not shown) may be deployed for higher speed long passages on a close reach to beam reach point of sail as in FIG. 8H. The kite sail may have control lines adjustable on a generally round control turn table.

Figure 8B:
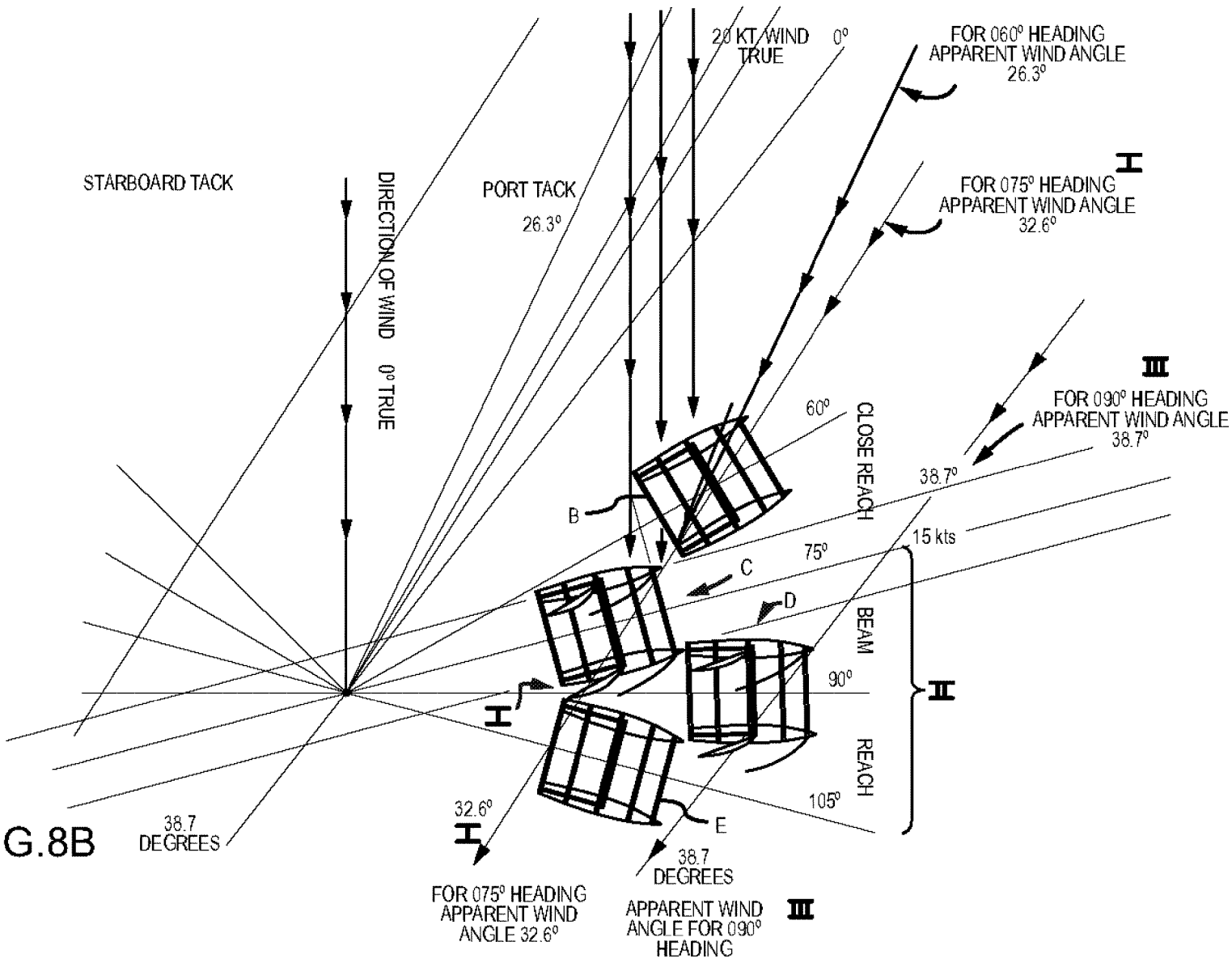
FIG. 8B shows a competitive designed twin masted Marconi rigged vessel and its shortcomings from close reach to beam reach points of sail, according to an embodiment.

FIG. 3B is an embodiment showing the mast 2250 in a generally lowered 2040 and operable position 2030. When in the stowed position 2040, mast 2250 is about minus 0 degrees with respect to the hull 2200. When in the operable position 2030, mast 2250 is about 72 degrees with respect to the hull 2200, but may vary in arc positions with respect to the hull(s) when balancing different sail configurations and their center of effort in relation to the center of leward resistance on the underwater profile area of the leeward hull (FIG. 8I). Varying the longitudinal arc positions of the bi-plane twin masted rig in relation to hulls, can be applied to vessel 10 (FIGS. 1, 2, 3A, and 4) and 20 (FIGS. 3B and 8I). The positions of the arc movement of the masts and mast step tube cavities 120, 220 (FIGS. 2, 3A, and 4) for vessel 10, and for vessel 20 (FIG. 3B) there are mast step tubes 2152 and 2252, can vary to accommodate different arc longitudinal portions of the cross wing twin masted rig. The variable designed positions of the mast step tube wells or cavities 2120, 2220 for vessel 20 (FIGS. 3B and 8I), or the mast step tubes wells or cavities 120, 220 for vessel 10 (See FIGS. 2, 3A, and 4), can also vary to the designed variable longitudinal positions of the masts 2150, 2250 for vessel 20, and mast 150, 250 for vessel 10, composing the cross wing twin masted rig.

FIG. 3B shows an embodiment of a vessel 20, with generally larger dimensions. Vessel 20 may generally have dimensions of 120 foot length and 65-70 foot width (in nautical terms—"beam"). Vessel 20 may include port hull 2200 and starboard hull 2100, masts 2150, 2250, and spars 2500, 2510, 2520, 2530 and 2570.

Vessel 20, in FIG. 3B, may have a generally similar configuration to vessel 10, with similar components. FIG. 3B shows a similar view to that of FIG. 3A. Vessel 20 includes two hulls, two masts, etc. all of which may not be shown in FIG. 3B.

In FIG. 3B, mast 2250 may recline from a generally upright position 2030 to a generally stowed away, down, or lowered position 2040. Mast 2250 may generally be seated or partially buried into a cavity 2230 (FIG. 3B), which runs longitudinally along the centerline of the deck from the bow to the mast step tube well or cavity 2220, that houses mast step tube 2252, which pivots relative to spar 2570, so as to be flush or nearly flush with the top decking. This configuration will allow a generally flat, obstacle free landing area for drones and vertical take-off and landing (VTOL) aircraft.

In FIG. 3B, mast 2250 couple or insert into a mast step tube 2252. Mast step tube 2252 may couple to and generally rotate or hinge with respect to the rear cross spar 2570 from the upright position 2030 to various positions, including stowed away position 2040 (FIG. 8I). Rear cross spar 2570 may have a generally circular cross section to facilitate the mast step tube 2252 to hinge off the generally round geometry of the stern cross spar 2570.

Mast 2250 may be constructed from generally round extruded aircraft aluminum alloy cylindrical tube, reinforced with high tenacity fibers that are filament wound around the aluminum cylindrical mast tube.

Decking (not shown) may include hard deck made of composite honeycomb structure carbon nanotube fiber reinforcing under a ⅛ inch (or greater) aluminum alloy plate. This configuration allows for a strong, lightweight decking for vessel 20, thereby not impairing the sailing performance of the vessel 20. The high strength to weight ratio honeycomb composite sandwich construction utilizing high tenacity fibers under the aluminum alloy plate, will allow aircraft and personnel on the upper aluminum surface, while maintaining the structural integrity of the decking without damaging the reinforcing honeycomb structural panel, and the structural integrity of the decking and vessel 20. This decking may come in the form of mounted or detachable panels configuring the vessel for a particular aircraft oriented mission package.

Hulls 2100, 2200 may be generally hollow inside allowing space for anti-submarine or airborne threat detection instrumentation, and may be made with high tenacity fiber composites reinforced with high strength ribs and/or lapstrake-type outer surface hull construction, with the lapstrake running longitudinally from front to back on the outboard side of the hulls 2100, 2200.

Alternatively high strength ribs on the interior of hulls 2100, 2200 may be made of high tenacity fiber tubular construction or high strength carbon nanotube honeycomb sandwich composite laminates that are generally rectangular in cross section and span the length of the hulls coupled or adhered to the interior of hulls 2100, 2200. This configuration would increase the longitudinal and lateral (hull crush) strength of vessel 20. The lapstrake construction would be bigger and more pronounced than vessel 10, if applied to vessel 20, and its effect on the bow hydrodynamic forces, and would be equally effective in decreasing the likelihood that vessel will front end capsize, as well as enhance the longitudinal stiffness of the hulls and strengthen the sides of the hulls against any lateral forces (waves) or blows (foreign objects).

Utilizing polyethylene terephthalate for hulls 2100, 2200 outer shell construction, may decrease the cost by enabling staged thermo injection molding of the hulls utilizing high temperature mica viewing ports to time the sequential initiation of injection ports activated to fill the heated cavity of the catamaran hull injection mold without capturing bubbles in the molded thermoplastic hull. This is in place of painstakingly laying up the hulls in a concave mold according to a lamination schedule, vacuum bagged for pressurized cooking, and curing of the laminates, all of which is very costly and time consuming, versus utilizing an abundance of recyclable thermoplastics available in mass abundance, and thermoforming the hull in thermoplastics using a hull mold in choosing an injection molding process. The deck mold can remain thermoset resin lay up and vacuum bag pressurized cooking because the deck configuration can change with the various configurations needed for different uses of vessel 20, civilian or military. Cost of multiple deck configurations in thermoplastic mold tooling would prohibitively drive up the unit cost of vessel 10, 20.

This type of rapid "squirting" out of the outer shells of the hulls 100, 200 of vessel 10 or hulls 1200, 2200 for vessel 20, combined with high strength composite construction ribs adhered or coupled to the interior of the hulls to give the hulls structural rigidity and using the same high strength composite construction with the honeycomb sandwich laminated panels for the bulkheads of the thermoplastic molded hulls to give the hulls rigidity, and water tight compartments, may be the most cost effective method in producing 200+ boats in a short amount of time, if needed. This configuration would allow for vessels having air surface landing capabilities, which may extend the United States' naval air arm and anti-submarine warfare coverage along many coastlines and to secure vital strategic waterways such as the Panama Canal, Straits of Gibraltar, Gulf of Aden, the Baltic Sea, the English Channel, etc. Combining 20-50 of these vessels in strategic areas with shore-based operations could provide a high quality of defensive system against enemy submarines and other offensive strategies.

Vessel 20 may be sized large enough to net and land drones or extended cruising range patrol aircraft (120 foot Cross Wing catamaran 20). With the cross wing masts 2150, 2250 in the upright position, vessel 20 may have a capturing net between the masts 2150, 2250 laying over the backstays 2161, 2261 (see FIG. 3B) with similar configurations to backstays 161, 261 (shown in FIG. 5), to snare or catch the drone or patrol aircraft. With vessel 20 configured with a generally flush deck to land, refit, and refuel VTOL/ASW aircraft from remote prepositioned/ocean based, variable depth aviation fuel bladders, this vessel 20 becomes an integral part of forward carrier-based naval operations.

The combination of quiet sailing propulsion, unlimited range, and the added capability of refueling A.S.W. aircraft far from its practical extended range from a carrier battle group, should make the Cross Wing catamaran 20 into that extra feather in the cap of the commander of a carrier battle group to sweep the seas of any lurking enemy.

In addition to providing a large and wide platform for catching and launching drones, launching and reeling in balloon sails, landing V.T.O.L. aircraft on the 120 foot long, 70 foot wide catamaran vessel 20, there is the additional utilization of the large catamaran platform for launching and utilizing controlled altitude deployment of high altitude sensors and early warning detection systems (RADAR-LIDAR) at an altitude that allows hyper horizon detection capabilities for threat identification and detection for defense applications.

FIG. 4 is a side view of a vessel 10, showing the mast in a generally upright position 30 with sails 700, 710 unfurled, according to an embodiment. In this embodiment, sail 710, the staysail may be the windward sail deployed on 066-090 degrees on points of the compass to the direction of the wind (0 degrees) on the port tack, and 270-294 degrees on the points of the compass to the direction of the wind (0 degrees) on the starboard tack (See FIG. 8D).

Also shown in FIGS. 2, 3A, 4 and 5, are mast step tube wells or cavities 220 in hull 200, and 120 in hull 100, which is configured to allow mast step tube 152 to extend into hull 100, and mast step tube 252 to extend into hull 200 such that masts step tube 152, 252 will not protrude outwardly beyond the edge of the hull 200 and the water tight integrity of hulls 100, 200 is maintained in this region of the hull 100, 200 structures. Mast step tube 152, 252 are configured to receive lower portions 156, 256 of masts 150, 250, such that the movement of mast step tubes 152, 252 will allow positioning of masts 150, 250. Vessel 20 (FIGS. 3B and 8I) with mast step tubes 2152, 2252 and mast step tube cavities 2120, 2220 have similar characteristics, functions, and applicable operations.

FIG. 5 shows a rear view of a vessel according to an embodiment. Hulls 100, 200 may be asymmetrical and may have a generally flat outer side in cross section 104, 204 and a generally convex inner side 106, 206. This configuration makes it possible to not include a center board, dagger board, or keel for leeward resistance when tacking upwind on a close hauled points of sail to half the points of sail on a broad reach encompassing all points of sail in between 045 degrees and 127 degrees on the points of sail on a compass to the direction of the wind (0 degrees) for the port tack, and 315-233 degrees on the points of sail on the compass to the direction of the wind (0 degrees) for the starboard tack. For downwind points of sail below 127 degrees on the point of the compass on the port tack with the wind at 0 degrees relative, the asymmetrical leeward resistance is not needed. For downwind points of sail below 233 degrees on the points of sail on the compass on the starboard tack to the direction of the wind (0 degrees), the asymmetrical leeward resistance of the hulls in not needed (see FIG. 8A).

FIG. 5 also shows the back stay stern bridle 270 and the control line 271 (FIG. 5) attached to the back stay strut 251, which proceeds downward toward spar 530 and turns on the roller surface of the stern roller 535 that rotates on the longitudinal geometry of spar 530. Control line 271 then passes through a block 272 that is attached to a back stay stern bridle 270 and proceeds to the block and tackle assembly 273 (FIG. 6) that is attached to backstay bow bridle 274, that is attached to both ends of spar 510, by which the back stay strut 251 lowers and raises the twin-masted rig.

In FIGS. 5 and 6, a stern roller 535 that rotates around a spar 530 facilitates the control line 271 transitioning its angular draw from block and tackle 273 to enable movement of back stay strut 251 to cause masts 150, 250 to move from a lowered mast position 40 in FIG. 3A for vessel 10, and position 2040 in FIG. 3B for vessel 20, to a raised mast position 30 for vessel 10 in FIG. 2, and raised mast position 2030 for vessel 20 in FIG. 3B, and back to a lowered mast position 40 in FIG. 2, or 2040 in FIG. 3B, if desired. This control line 271 is connected to the 6 to 1 purchase block and tackle 273 (FIG. 6) twin-masted hoisting rig mounted under the deck between the dome shelter nacelle structures 110, 210 (see FIGS. 1 and 5), and straddles spar 520 under deck 680 and 690 (See FIG. 6). Block and tackle assembly 273 is attached to a support bridle 274 that is anchored to spar 510 at two points (See FIG. 6).

FIG. 5 also shows the internal stay structure for the twin-masted rig keeping the twin-masted rig from falling side to side 180, 280, and the back stay configuration 161, 261, keeping the twin-masted rig from falling forward.

FIG. 6 is a top view of a vessel 10, according to an embodiment. This example shows the sails 700, 710 generally at 90 degrees or perpendicular with respect to the hulls 100, 200 extending in opposite directions. In practice the sails 700, 710 would extend generally in the same direction when the vessel 10 is on a close hauled to broad reach points of sail where the sails are drawing from the wind direction that affect sails equally. This is for illustration purposes to show the unencumbered 180 degree or more of arc travel of the sails 700, 710 (FIG. 7). Vessel 10, 20 may also include preventers 611, 613 (not shown on vessel 20), which are safety features rigged to prevent overextended jibing. Over-extended jibing may occur when the sail and the boom catches wind from a different angular downwind direction, causing the sail to back and suddenly swing onto the other tack in a sudden manner.

Vessel 10 may also include decking 680, 685, 690. Decking 685 may include cross nylon webbing with 2×2 inch square voids between 2 inch wide webbing. Decking 690 may include trampoline mesh for the decking platform allowing water to pass through the mesh panel structure, so the water will not pool on the decking material. Decking 680 may include 0.5 inch epoxy or phenolic resin honeycomb sandwiched core panel with carbon nanotube fiber cloth laminate for the top and bottom structural facings of the honeycomb core sandwich panel. This configuration (FIG. 8H) is to facilitate the structural mounting of the round control table that controls the kite sail when it is deployed. It will be appreciated that other materials may be used for decking 680 (FIG. 6), without straying from the spirit and scope of this disclosure.

FIG. 7 shows an overhead view of a vessel 10 close hauled tacking, according to an embodiment. Also shown are the two sails 150% Genoa sails 700 from FIGS. 1 and 4, in positions for tacking into the wind. For close hauled tacking from port tack to starboard tack and back again to port tack on a repeated basis to go upwind, the twin-masted rig in this configuration (FIG. 6) with two 150% Genoas and booms 610,612 swinging unencumbered by the masts 150, 250, switching tacks with no readjustment of the Genoa sheet lines 563, 564 by their respective port and starboard block and tackle rigs 620 on the port and 625 on the starboard side. This rig of two 150% Genoas will be the most efficient and fastest sail configuration going upwind on a close hauled points of sail (45-60 degrees) to the direction of the wind (0 degrees) on the port tack, and 315-300 degrees to the direction of the wind (0 degrees) on the starboard tack and back again and again if necessary to reach a destination that is dead to weather (sailing terminology for directly upwind). At a true wind angle of 45 degrees (close hauled point of sail) with 20 knots of wind and assuming a boat speed of 10 knots, the apparent wind angle is 30 degrees.

FIG. 8A shows a vessel at different positions in relation to the wind direction, according to an embodiment. This FIG. 8A shows the points of sail positions for a vessel for close hauled point of sail with the wind veering through the different points of sail to the stern of the vessel for a dead run point of sail.

A laterally spaced, two-masted rig has been called the "twin masted" rig, or "Bi-Plane" rig. Utilizing non-turbulent wind to affect the leeward sail will increase the performance factor of the twin masted rig in terms of $kg/m^2$ of force exerted on the leeward sail, propelling the vessel 10 (as seen in FIGS. 1, 3B, 4, 5, and 6) forward with increased efficiency and power.

Compare the above twin masted concept, to a concept of splitting the twin masted configuration on one hull incorporating a single masted Marconi rig on one hull of the catamaran twin hull configuration, and another single masted Marconi rig on the hull directly abeam of the first Marconi rig. FIG. 8B outlines the problem of the Marconi rig in twin masted or biplane configuration. This Marconi rig in the twin masted realm of sail configurations is composed of a 120% Genoa or larger sail forward of a vertically stepped mast, and a full mainsail rigged aft of the mast. This rig, on beam reach points of sail 075 degrees to the direction of the wind (0 degrees on the port tack), and points of sail below that, including a broad reach, (See FIG. 8B), creates downwind turbulence and shadows the leeward main of this particular twin-masted Marconi rigged sail configuration. This is different than the design and operation of the current embodiments of the vessel 10 and rig (FIGS. 1, 3B, 4, 5, and 6). The configuration of vessel 10 as described in the embodiments herein will not have the same limitations as the Marconi twin masted, split rigged, design (See FIG. 8B).

The turbulent wind effect on the twin masted Marconi rigged sail configuration takes debilitating effect at a vessel heading of 075 degrees to the direction of the true wind (0 degrees). Turbulent wind and its debilitating effect on the on the efficiency of the Marconi rig, increases as the vessel bares away (in nautical terminology or turn away from the wind) or increase its downwind points of sail going from close reach to beam reach points of sail.

With a 20 knot wind condition and an apparent wind heading of 32.6 degrees relative to the vessel heading (075 degrees) relative to the direction to the true wind direction (0 degrees), the debilitating effect of the wind turbulence begins to effect the leward side of the Marconi twin masted rig at the leeward mainsail (See FIG. 8B, feature "I", and vessel "C").

The scientific formula for this calculation is based on the apparent wind speed ($\vec{A}$), true wind speed ($\vec{W}$), boatspeed ($\vec{V}$), and headwind speed ($\vec{H}=-\vec{V}$). On a vessel heading of 090 (vessel "D") relative to the true wind direction (0 degrees) with a true wind speed of 20 knots and a multihull boat speed of 25 knots, the apparent wind angle is 38.7 degrees and the blanketing turbulent wind effect on the split Marconi rig, is total (See FIG. 8B, feature "III", and vessel "D"). The leeward main on the Marconi rig becomes totally ineffective (See FIG. 8B, feature "III"). The twin masted Marconi sail configuration has marginal performance capabilities in the beam reach points of sail 075-105 degrees on points of the compass on the port tack to the direction of the wind 0 degrees and 255-285 degrees on the points of the compass on the starboard tack, to the direction of the wind 0 degrees, because of the total blanketing of the leward main due to turbulent air (dirty wind) (See FIG. 8B, feature "II", vessels C, D, and E).

Figure 8C:
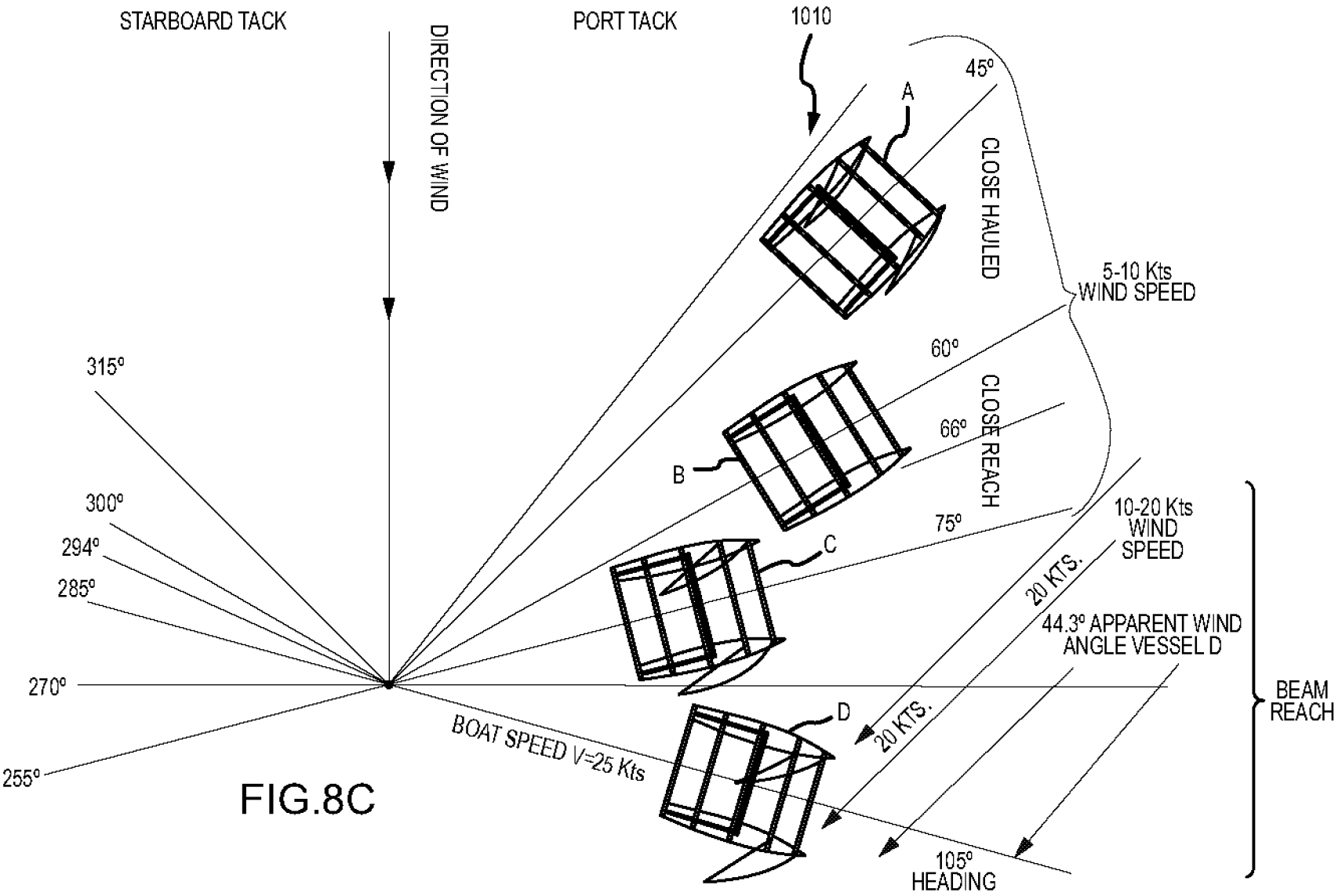
FIG. 8C shows a vessel and two 150% Genoa sail positions for the close hauled through beam reach points of sail, according to an embodiment.

The flow of the wind over both 150% Genoa sails in the cross wing rig, is uninterrupted and non-turbulent well into the beam reach points of sail at 090 degrees to the direction of the true wind (0 degrees) (See FIG. 8C). This is a significant performance improvement over the split Marconi bi-plane rig configurations, which loses at least 20%, and up to 25%, of its effective sail area to turbulence at the 090 degree heading relative to the true wind direction (0 degrees). This is why the 150% Genoa sails of the cross wing rig on vessel 10 of FIGS. 1, 3B, 4, 5, 6 and 8C, and the staysail rigged in tandem with the 150% leward Genoa in FIG. 8D, as well as the various sail and helium sail configurations in FIGS. 8E-8G, and the close reach to beam reach passage (long distance single tack sailing) involving hyper-performance speed kite sail deployment controlled on a turntable (see FIG. 8H) with a lowered twin mast configuration; make the cross wing rig significantly more versatile and efficient on all points of sale versus the split Marconi twin masted rig of FIG. 8B.

Wind velocity formulas are shown as Equations 1 and 2 show the calculations used in the above example.

$$\vec{A}=\vec{A}=\vec{W}+\vec{H} \qquad \text{EQN 1:}$$

$$\vec{H}=-\vec{V} \qquad \text{EQN 2:}$$

Figure 9:
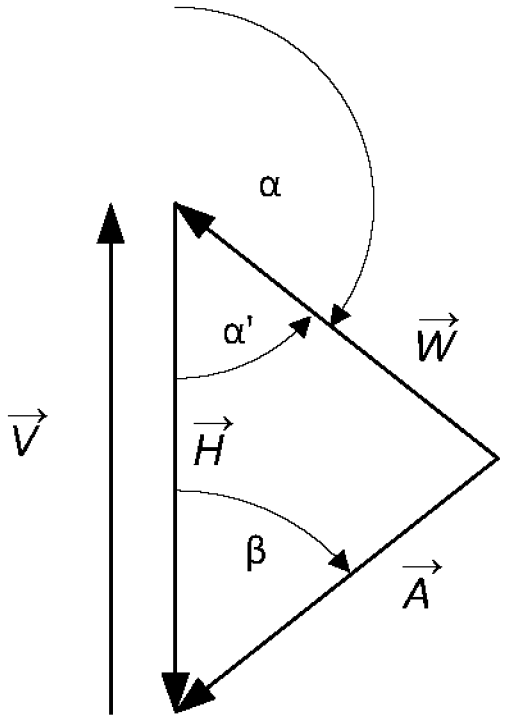
FIG. 9 is a graphical representation used for angular wind direction calculations, according to an embodiment.

Angular wind direction equations used in the above example are shown in FIG. 9.

Where β=the angle of apparent wind

α=pointing angle $\vec{A}$=the apparent wind $\vec{V}$=boat speed $\vec{H}$=headwind $\vec{W}$=true wind FIG. 8C shows sail positions on vessel 10 with two 150% Genoa sails for close hauled to beam reach points of sail. These points of sail can utilize two 150% Genoas for 180 degrees out of 360 degrees of points of sail, or 45 degrees to 90 degrees on the port tack from the direction of the wind (0 degrees), to 315 degrees on points of the compass to 270 degrees to the direction of the wind (0 degrees) on the starboard tack, in light winds (5-10 knots).

In heavier winds (10-20 knots), two 150% Genoas can be used for 210 degrees points of sail from 045 degrees on the points of the compass to 105 degrees on points of the compass to the direction of the wind (0 degrees) on the port tack, and from 315 degrees on the points of the compass to 255 degrees on the points of the compass to the direction of the wind (0 degrees) on the starboard tack. On a course of sail where vessel "D" is on a heading 105 degrees points of sail on the compass to 0 degrees to the direction of the wind, the apparent wind angle 44.3 degrees with a boat speed of 25 knots (See EQNs. 1 and 2, and FIG. 9).

The two 150% Genoas may be less turbulent and a more defined preponderance of the direction of the wind due to the increased wind speeds. Lighter winds have a greater proportion of wind turbulence relative to the wind speed reducing the effectiveness or "blanketing" the leeward sail configuration on beam reach and lower points of sail for the bi-plane rig with two 150% Genoas, rending it less effective the further vessel 1010 bares away or changes course putting the wind abeam (sideways in nautical terms), shifting to blowing toward the sterns and blanketing the leeward 150% Genoa.

These points of sail comprise more than one half of all points of direction on the compass that a vessel 1010 can go effectively with the bi-plane rig with two 150% Genoas side by side configured on the cross-wing rig (see FIG. 8C).

Figure 8D:
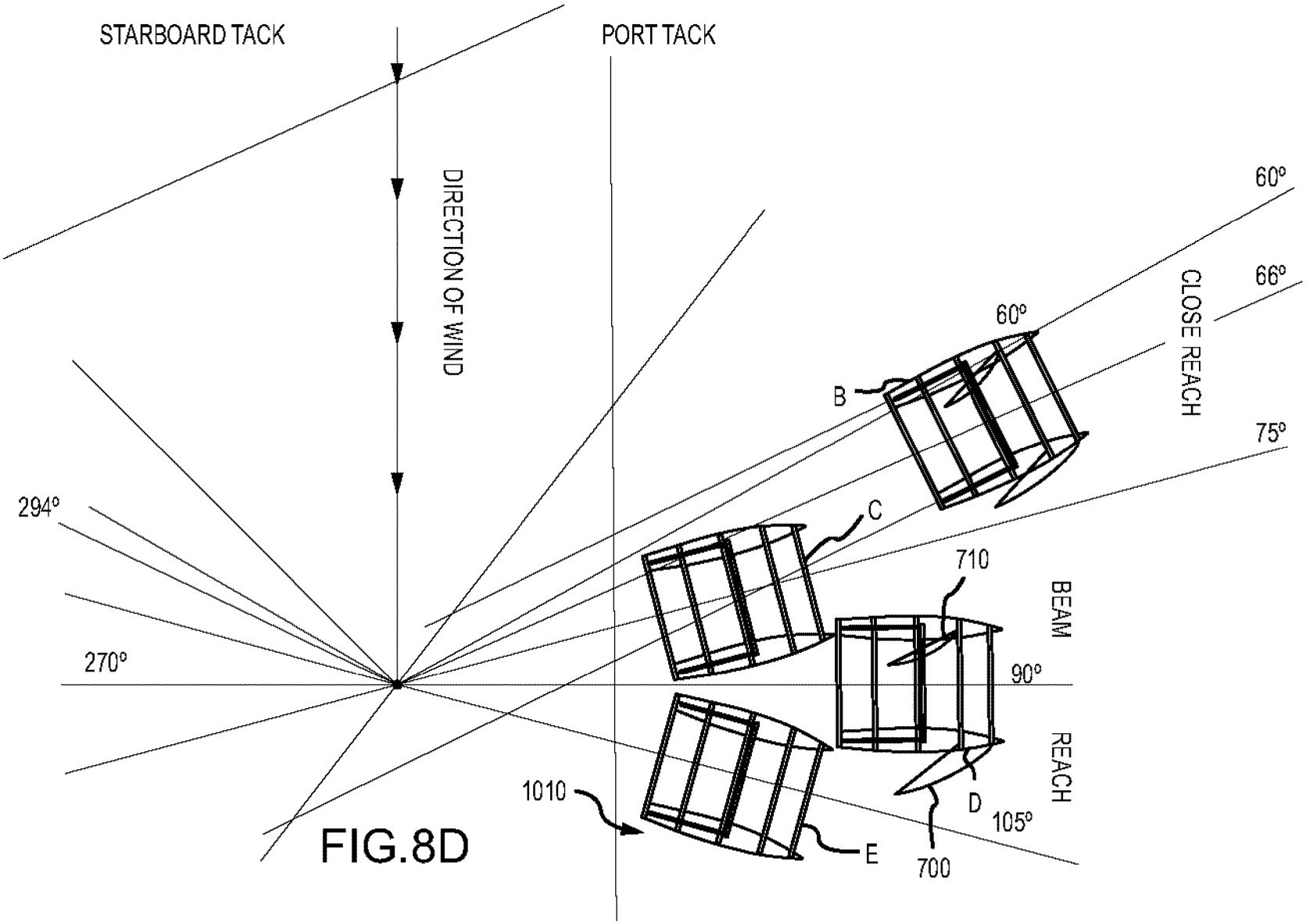
FIG. 8D shows a vessel and staysail and 150% Genoa sails for close reach through beam reach points of sail, according to an embodiment.

FIG. 8D shows light air (5-10 knots) sail and vessel 1010 reference positions for half the close reach, and half the beam reach points of sail utilizing a 90-100% staysail to windward, and a 150% genoa sail to the leeward. Using Eqns. 1 and 2 and FIG. 9 (similar to the calculations for FIG. 8C), the sail configuration in FIG. 8D allows an efficient volume of apparent wind to pass to the leward sail on close reach and beam reach points of sail to fully utilize the entire length of the leward Genoa sail foil.

As shown in FIG. 8D, with a reduced sail configuration on the windward side of the bi-plane rig replacing a 150% Genoa with a 90-100% staysail, amounts to a 40% reduction of sail for the windward side (but only 20% reduction for the Bi-Plane rig overall). The Bi-Pane rig can effectively utilize the leeward side of the Bi-Plane sail configuration on close reach and beam reach points of sail because the windward 150% Genoas blanketing effect on the leeward 150% Genoa is removed and replaced by a 90-100% staysail 710, and still retain 60% of the sail area on the windward side of the Bi-Plane rig.

From 066 degrees to 090 degrees on points of the compass to the direction of the wind (0 degrees) on the port tack, to 270 degrees-294 degrees on the points of the compass to the direction of the wind (0 degrees) on the starboard tack, the Bi-Plane rig with only a 20% overall reduction of sail area can sail 48 degrees more points of sail on the compass that includes half the points of sail on a close reach and half the points of sail on a beam reach that has comparable sail area to a performance Marconi single-masted rig.

Figure 8E:
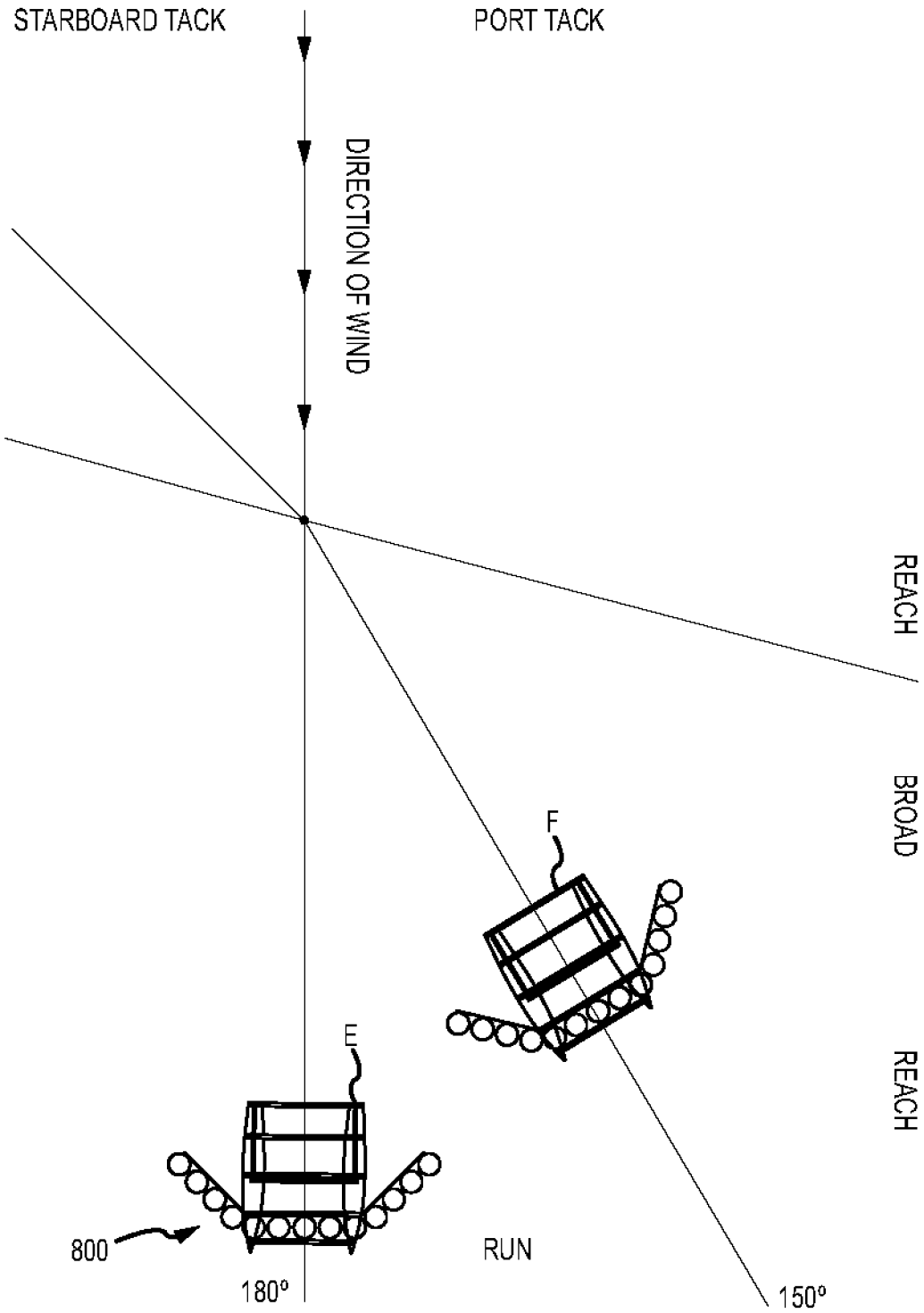
FIG. 8E shows a vessel and lighter than air sails for downwind points of sail, according to an embodiment.

FIG. 8E shows lighter than air (helium) sails 3000 configured to capture and harness the wind coming from the vicinity of the stern of the vessel. Sail positions on downwind run points of sail on the compass to the direction of the wind (0 degrees) from 150 degrees to 180 degrees on the port tack, and 210 degrees to 181 degrees on the starboard tack can utilize the lighter than air physics of reducing the displacement of the vessel 1010 on the water while propelling the vessel 1010 through the water. This will create a reduced wetted surface on the hull and reduced underwater profile area of the vessel 1010, which causes a reduced drag on the vessel 1010 due to the water. The lighter than air sails have a greater wind capturing surface area compared to the sails configured on the masts of the Bi-Plane rig, and other rigged vessels.

Helium filled sails may allow some, or all, of the vessel 1010 to remain out of the water, and may allow the vessel 1010 to be airborne or only contact the tops of the waves. This new type of sailing will incur different names for the activity. This may be called wave skipping, or cloud hitching or hopping, but the steering of vessel 1010 in this mode of skipping or sailing can include the dragging of warps (long thick ropes) or drogue(s) (hydrodynamic drag implements attached to the warps), which can control the direction of vessel 1010 keeping the bows forward piercing the waves that vessel 1010 may overtake while in airborne or skipping mode.

Additions or subtractions of warps and drogue(s) in the stern section of the port hull or the starboard hull of the catamaran may be used to steer vessel 1010 while airborne in conjunction with paravanes. Additions of paravanes deployed off the starboard or port hulls in the bow section will allow the steering of the bows while airborne, to angularly deviate from the dead down wind direction the helium sails are dragging vessel 1010. The additional utility of using paravanes for steering the bows in a dead downwind position of airborne sailing gives a military application of a naval variety apparent to anyone experienced in modern naval warfare. In a sailing configuration other than helium sails, retractable rudders 290, 291 (See FIG. 8I) in forged aircraft aluminum alloy rudder housings reinforced with carbon nanotube fiber, are a reliable and secure implement for steering vessel 10, 20, 1010, etc.

Figure 8F:
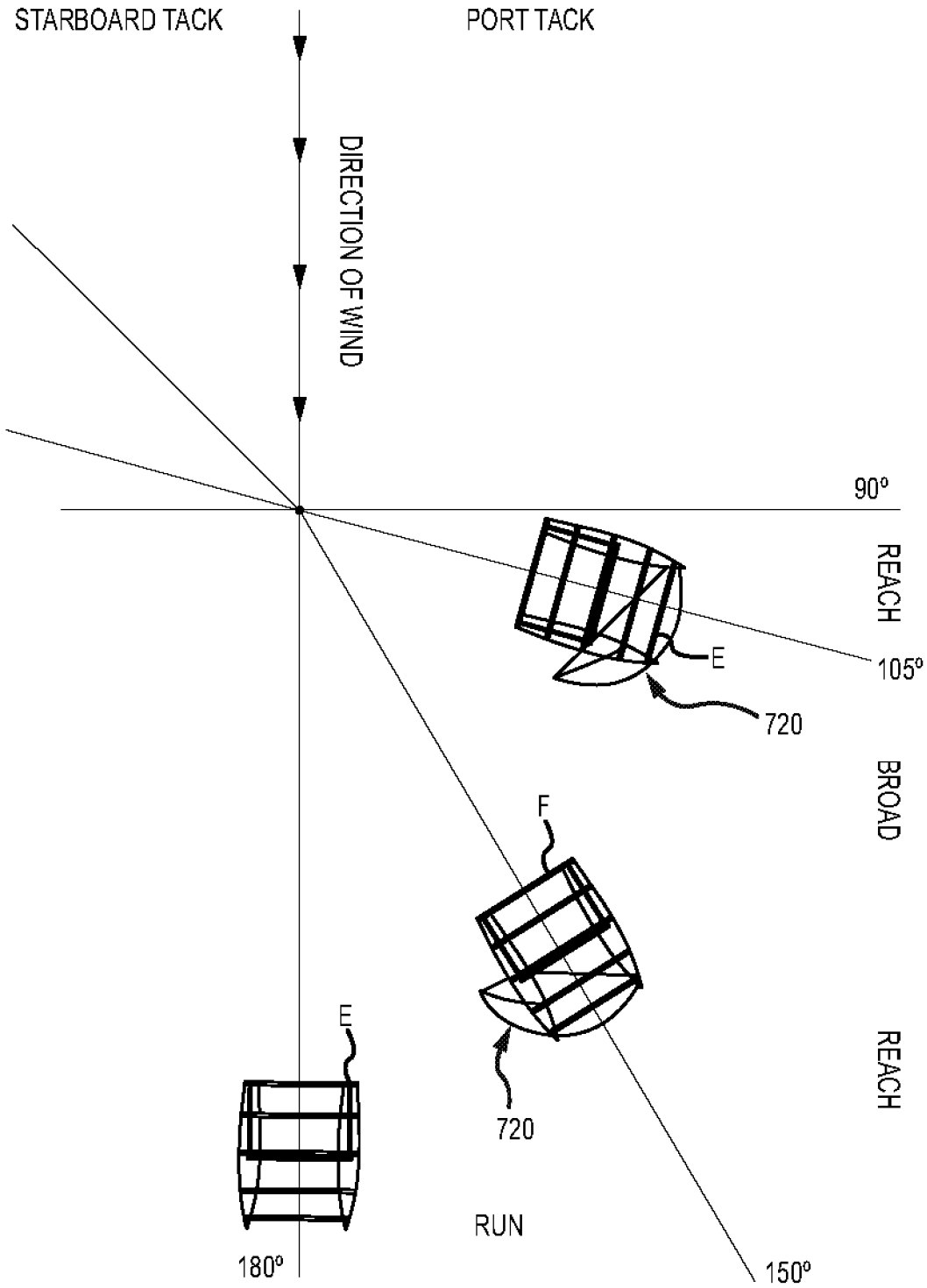
FIG. 8F shows a vessel and a 200% blooper or drifter sail positions for downwind points of sail, according to an embodiment.

As shown in FIG. 8F, in a conventionally rigged twin masted or Bi-Plane rig vessel "E" for sailing downwind, including points of sail on the compass from 105-150 degrees on the points of compass to the direction of the wind (0 degrees) on the port tack, and 255-210 degrees on the points of the compass to the direction of the wind (0 degrees) on the starboard tack, may include a variety of downwind sail configurations with variations on both masts, sail sizes, and shapes.

On points of sail including the broad reach points of sail 105-150 degrees on the points of the compass to the direction of the wind 0 degrees, on the port tack, and points of sail on the compass 255-210 degrees to the direction of the wind 0 degrees on the starboard tack, a mast height extension strut 350 can be hoisted with a 150% genoa Halyard on the leeward mast of a bi-plane rig to hoist a 200% enveloping blooper or drifter sail 720. This configuration may be used for light (5-10 knots) downwind points of sail, reaching performance downwind runs, by extending the mast length by 25-50% with the mast extensions 350, depending on wind conditions (See FIGS. 8F and 8I).

Going wing and wing (similar to FIGS. 6 and 8G) with standard 150% Genoa sail on the vessel 10 with conventional mast height in moderate to heavy winds (10-20 knots) is one option, and extending the mast height by 25-50% depending on the reduced light air conditions for a short passage is another option (See FIGS. 8F and 8I).

Figure 8G:
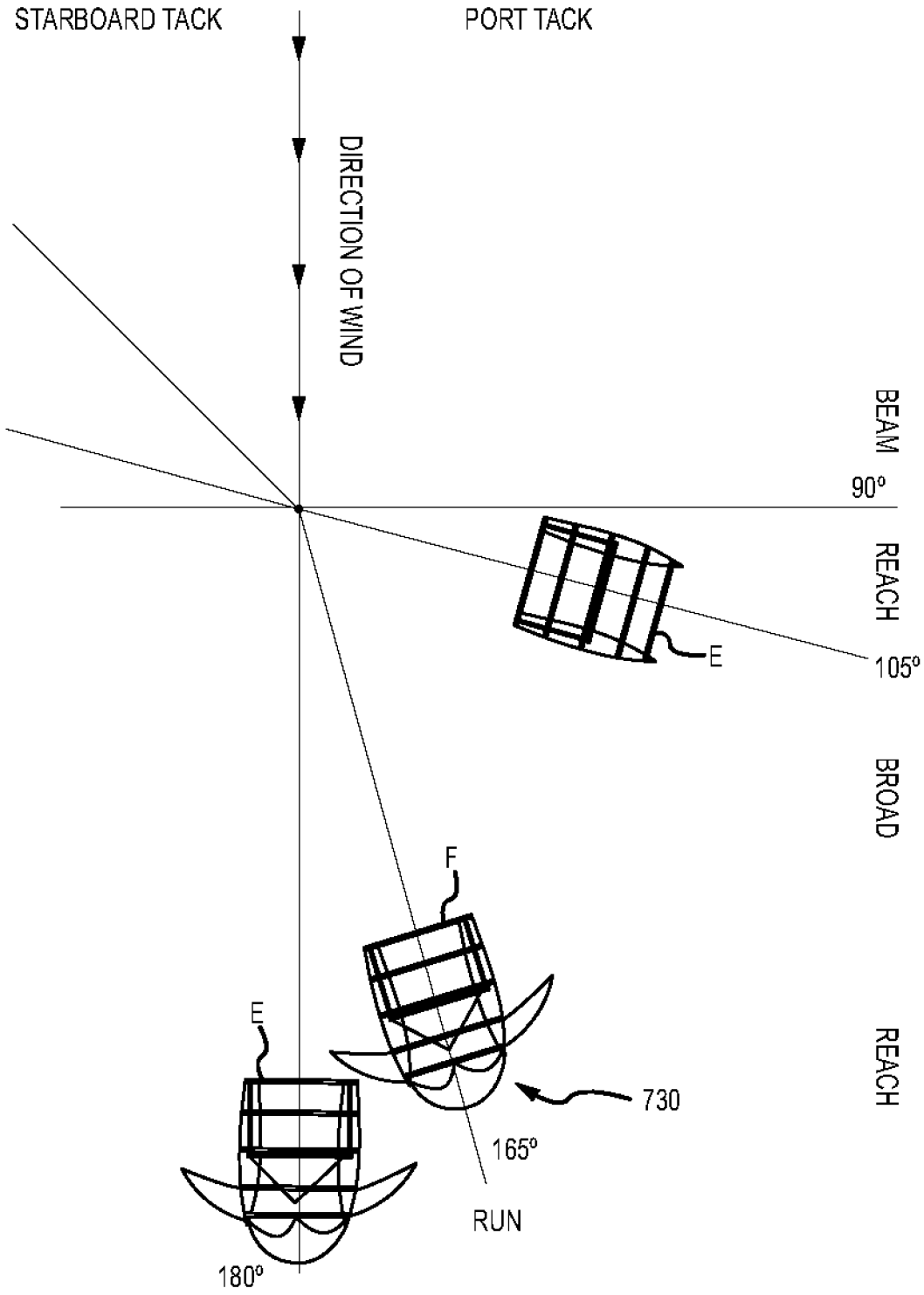
FIG. 8G shows a vessel and sail positions for downwind points of sail using 150% Genoa sails in a wing and wing configuration, with a generally rectangular sail or spinnaker filling the void between the masts, according to an embodiment.

In FIG. 8G, going downwind on a run 165 degrees-180 degrees on points of the compass to the direction of the wind (0 degrees) on the port tack, to 196-181 degrees on the points of the compass to the direction of the wind (0 degrees) on the starboard tack on short passages, can be accomplished by going wing and wing with a significant safety margin with the conventional Bi-Plane rig utilizing both starboard and port 150% Genoa sails. Additionally, on downwind points of sail, both a light or heavy aired spinnaker 730 or a square sail, or a square top spinnaker, can be used by filling the slot between the port and starboard masts (See FIG. 8G).

Drifters 720 can also be deployed, depending on the wind conditions for half the beam reach points of sail and all the broad reach points of sail (090-150) degrees on the points of the compass to the direction of the wind (0 degrees) for the port tack, to 270-210 degrees on the points of the compass to the direction of the wind (0 degrees) on the starboard tack. The cross wing rig can utilize a mast height extension strut 350 (See FIG. 8I) to extend the mast height by 50% in light winds (3-10 knots) (See FIGS. 8F and 8I).

Figure 8H:
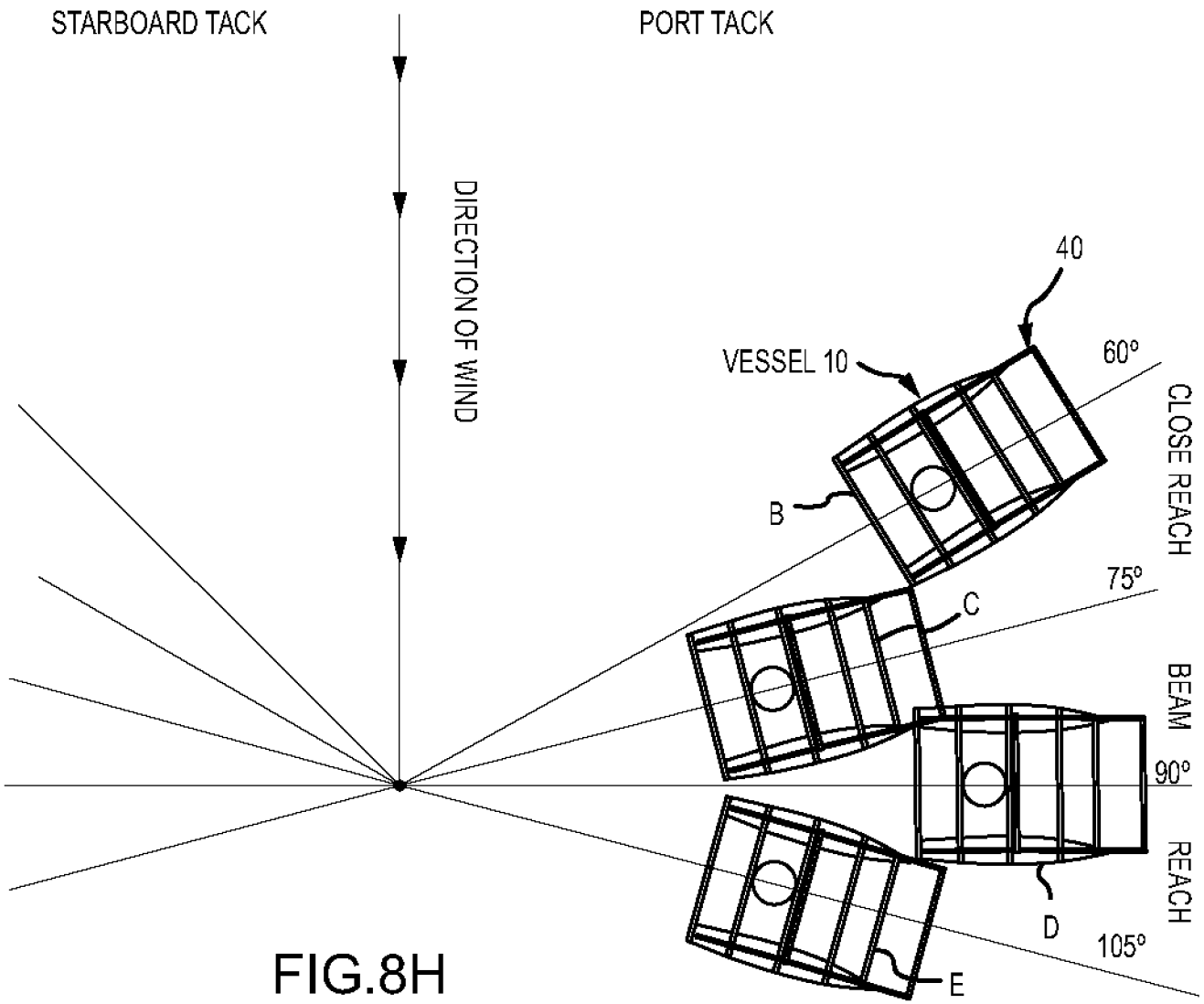
FIG. 8H show a vessel and sail positions from close reach to beam reach points of sail for the implementation of a generally round control table for the deployment of a kite sail, according to an embodiment
Figure 8I:
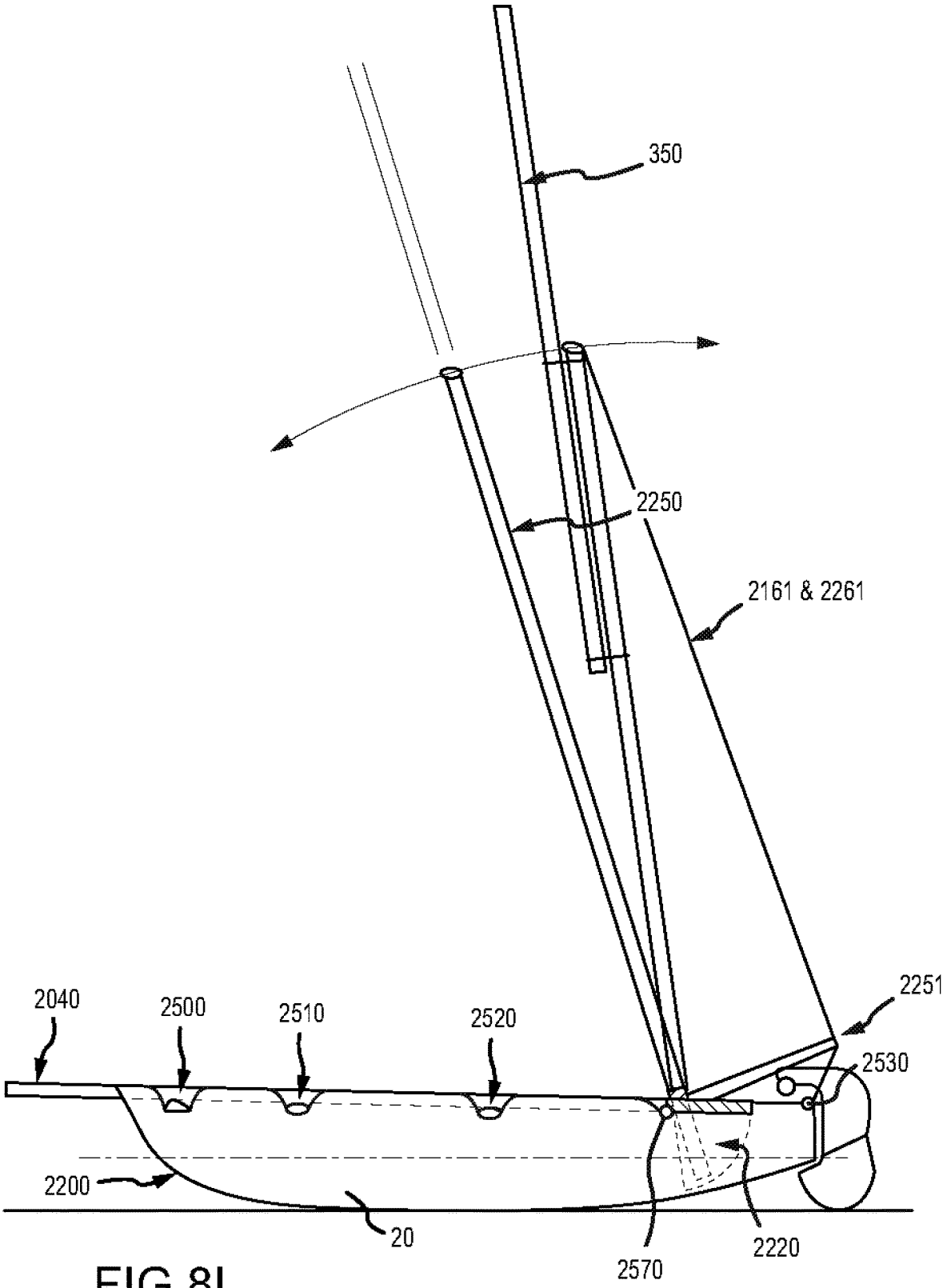
FIG. 8I shows a vessel with a mast extension and a rudder assembly, according to an embodiment.

FIG. 8H shows a vessel 10 both masts reclined in the stowed position 40, the deployment and full exercise space for a kite sail and its roundtable control platform, becomes deployable on an operational basis for 4 points of sail out of a possible 10. Both close reach and beam reach points of sail for both starboard and port tacks, gives us 4 points, or rather covers over 25% of the points of compass that a sailing vessel can go.

Narrow navigable water channels with numerous tall masted vessels or pine trees on either side of a narrow boat channel that has to be navigated with headwinds, renders the deployment of a kite sail as a hazardous proposition. Deployment on long passages is a more likely option that is both practical and safety oriented avoiding close in quarters interference, and high speed collisions in crowded channels and harbors.

High speed and reduced passage times between points of departure and arrival are an advantage that future sail propulsion systems will take advantage of, especially in multihull design. The catamaran 10 with the structural integrity of 2 hulls 100, 200 with one mast 150, and/or 250 stepped in each hull may weather the engineering challenge coming from combining retractable twin masted sailing rigs with kite sail configurations that include central control tables mounted on deck between the hulls of a catamaran. The Cross Wing rig and its retractable sail and mast configurations provides for this design requirement perfectly without naval architectural or sail rig interference.

In addition, the large deck area of a "Cross Wing" rigged catamaran 10 can fully accommodate the large area needed to launch and retrieve lighter than air sails, or helium sails, for downwind passages where passage time and speed are essential to a successful trip. These types of lighter than air sails are in development, but a practical platform is needed on which to deploy the massive square footage of lightweight material to go down wind, but still be safe and practical in performance sailing going upwind when the balloon sails are stowed and the high tenacity filament wound pressure tanks for helium are discontinued in usage or jettisoned for speed.

By splitting the rig and acquiring a large sail rig-free area by reclining the masts, creates an area to mount a solid control roundtable for a kite sail and deployment of a lighter than air sails, such as a helium filled sail. Wide area displacement lifting bridles for balancing the displacement of vessel 10 while flying a lighter than air sail, is a viable rigging option when both masts are reclined in a stowed position 40 (see FIGS. 3A and 8H) and vessel 10 becomes airborne intermittently, or for long periods of time.

Larger catamarans 20 (see FIGS. 3B and 8I) of about 120 foot length with 65-70 foot beams (overall width) can utilize the twin-masted "Cross Wing" configuration to net and land drones as an extended cruising range patrol craft (120 foot Cross Wing catamaran) in addition to fully retract the Cross Wing masts on a generally flush deck to land, refit, and refuel VTOL/ASW aircraft from remote prepositioned/ocean-based variable depth aviation fuel bladders.

The combination of quiet sailing propulsion, unlimited range, and the added capability of refueling A.S.W. aircraft far from traditional aircraft carrier range, should make the Cross Wing catamaran into that extra feather in the cap of the commander of a carrier battle group to sweep the seas of any lurking enemy under the seas, namely enemy submarines.

In addition to providing a large and wide platform for catching and launching drones, launching and reeling in balloon sails, landing V.T.O.L. aircraft with 120 foot long, 70 foot wide catamarans shown in FIG. 3B, there is the additional utilization of the large catamaran platform for launching and utilizing controlled altitude deployment of high altitude sensors and early warning detection systems (RADAR-LIDAR) at an altitude that allows hyper horizon detection capabilities for threat identification and detection for defense applications.

Although specific embodiments of the disclosure have been described, various modifications, alterations, alternative constructions, and equivalents are also encompassed within the scope of invention as set forth in the claims.

The specification and drawings are, accordingly, to be regarded in an illustrative rather than a restrictive sense. It will, however, be evident that additions, subtractions, deletions, and other modifications and changes may be made thereunto without departing from the broader spirit and scope of invention as set forth in the claims.

What is claimed is:

1. A sailing vessel, comprising:

a first hull member comprising a bow portion and stern portion, and port side and starboard side;

a second hull member comprising a bow portion and stern portion, and port side and starboard side;

a first mast pivotally coupled adjacent to one of the first hull member or the second hull member configured to pivot toward the bow portion of the first hull member or the second hull member from an upright position to a stowed position;

a stabilizer coupled adjacent the bow portions of the first hull member and the second hull member, wherein the stabilizer comprises a generally flat lower surface and a generally parabolically curved convex upper surface.

2. The vessel of claim 1, wherein the first and second hull members comprise a generally bulbous portion adjacent the bow portion of the first and second hull members to increase the buoyancy of the first and second hull members and reduce the likelihood vessel will front end capsize.

3. The vessel of claim 1, wherein the first and second hull members comprise a generally flat outboard side and a generally convex inner side, which reduces the need for a dagger board, centerboard, or keel.

4. The vessel of claim 1, further comprising one or more spars rigidly coupling the first hull member and the second hull member.

5. The vessel of claim 1, further comprising one or more sails configured to couple to the first mast or the second mast and pivot 180 degrees with respect to the first mast or second mast.

6. The vessel of claim 1, further comprising a second mast pivotally coupled to the other of the first hull member or the second hull member, configured to pivot toward the bow portion of the second hull from an upright position to a stowed position, and a capspar configured to generally rigidly couple the first mast and the second mast adjacent to a top portion of the first mast and the second mast.

7. The vessel of claim 1, wherein the first hull member or the second hull member comprises a dome portion configured to allow a person to reside therewithin.

8. The vessel of claim 7, further comprising a domespar coupled to the dome portions of the first and second hull members.

9. The vessel of claim 8, further comprising a mast step tube strut pivotally coupled to the domespar and configured to accept a lower portion of the first and second mast to allow pivoting of the first and second mast generally in unison with respect to the first and second hulls.

10. The vessel of claim 9, wherein the first hull and the second hull further comprise mass step tube cavities configured to allow the mast step tubes to extend therewithin.

11. The vessel of claim 10, further comprising a back stay strut coupled adjacent the mast step tubes, configured to allow positioning of the first mast and the second mast.

12. The vessel of claim 1, wherein the stowed position of first mast or second mast is about minus 20 to plus 10 degrees with respect to the first or second hull.

13. The vessel of claim 1, wherein the upright position of the first or second mast is about 70-90 degrees relative to the first hull or second hull.

14. The vessel of claim 1, further comprising a mast height extension strut moveably coupled to first mast or second mast, to extend above the height of the first mast or the second mast, to allow the use of a taller and larger sail for use in light downwind sailing conditions.

15. A sailing vessel, comprising:

a first hull member comprising a bow portion and stern portion, and port side and starboard side;

a second hull member comprising a bow portion and stern portion, and port side and starboard side;

a first mast pivotally coupled adjacent to one of the first hull member or the second hull member configured to pivot toward the bow portion of the first hull member or the second hull member from an upright position to a stowed position;

a stabilizer coupled adjacent the bow portions of the first hull member and the second hull member, wherein the stabilizer comprises a generally flat lower surface and a generally parabolically curved convex upper surface, wherein the stowed position of the first mast is about minus 20 to plus 10 degrees with respect to the first or second hull member, wherein the upright position of the first or second mast can vary from about 70-90 degrees relative to the first hull or second hull member.

16. The vessel of claim 15, wherein the first and second hull members comprise a generally flat outboard side and a generally convex inner side, which reduces the need for a dagger board, centerboard, or keel.

17. The vessel of claim 15, further comprising a second mast pivotally coupled to the other of the first hull member or the second hull member, configured to pivot toward the bow portion of the second hull from an upright position to a stowed position, and a capspar configured to generally rigidly coupling the first mast and the second mast adjacent to a top portion of the first mast and the second mast.

18. The vessel of claim 15, further comprising a mast height extension strut moveably coupled to first mast or second mast, to extend above the height of the first mast or the second mast, to allow the use of a taller and larger sail for use in light downwind sailing conditions.

19. A sailing vessel, comprising:

a first hull member comprising a bow portion and stern portion, and port side and starboard side;

a second hull member comprising a bow portion and stern portion, and port side and starboard side;

a first mast pivotally coupled adjacent the first hull member or the second hull member configured to pivot toward the bow portion of the first hull member or the second hull member from an upright position to a stowed position;

a stabilizer coupled adjacent the bow portions of the first hull member and the second hull member, wherein the stabilizer comprises a generally flat lower surface and a generally parabolically curved convex upper surface, wherein the first and second hull members comprise a generally flat outboard side and a generally convex inner side, which reduces the need for a dagger board, centerboard, or keel, wherein the stowed position of the first mast is about minus 20 to plus 10 degrees with respect to the first or second hull, wherein the upright position of the first mast can vary from about 70-90 degrees relative to the first hull or second hull, wherein the varying of the first mast position, varies the center of effort of wind force on a sail coupled to the first mast, in relation to the center of leward resistance on an underwater profile area of a leward hull.

20. The vessel of claim 19, further comprising a removable mast height extension strut, moveably coupled to the first mast, to extend above the height of the first mast, to allow the use of a taller and larger sail for use in light downwind sailing conditions.

* * * * *